US012214267B2

(12) United States Patent
Goserud

(10) Patent No.: US 12,214,267 B2
(45) Date of Patent: Feb. 4, 2025

(54) GOLF TEE TOOL

(71) Applicant: J. Thomas Goserud, Landisville, PA (US)

(72) Inventor: J. Thomas Goserud, Landisville, PA (US)

( * ) Notice: Subject to any disclaimer, the term of this patent is extended or adjusted under 35 U.S.C. 154(b) by 118 days.

(21) Appl. No.: 17/808,844

(22) Filed: Jun. 24, 2022

(65) Prior Publication Data

US 2022/0409968 A1 Dec. 29, 2022

Related U.S. Application Data

(60) Provisional application No. 63/265,383, filed on Dec. 14, 2021, provisional application No. 63/202,780, filed on Jun. 24, 2021.

(51) Int. Cl.

| | |
|---|---|
| ***A63B 57/20*** | (2015.01) |
| *A63B 57/30* | (2015.01) |
| *A63B 57/35* | (2015.01) |
| *A63B 57/50* | (2015.01) |

(52) U.S. Cl.

CPC ..... *A63B 57/203* (2015.10); *A63B 57/207* (2015.10); *A63B 57/35* (2015.10); *A63B 57/353* (2015.10); *A63B 57/50* (2015.10); *A63B 2209/08* (2013.01)

(58) Field of Classification Search

CPC ..... A63B 57/203; A63B 57/207; A63B 57/35; A63B 57/353; A63B 57/50; A63B 2209/08; A63B 47/02; A63B 2225/68; A45F 2200/05; A45F 2200/0575; A45F 5/00; A45F 2005/006

See application file for complete search history.

(56) References Cited

U.S. PATENT DOCUMENTS

| | | | | |
|---|---|---|---|---|
| 4,537,403 A * | 8/1985 | Farina | A63B 60/14 473/316 |
| 5,494,202 A * | 2/1996 | Wyatt | A63B 57/20 224/919 |
| 6,220,973 B1 * | 4/2001 | Hsu | A63B 57/203 473/406 |

(Continued)

FOREIGN PATENT DOCUMENTS

WO WO-2021005195 A1 * 1/2021

OTHER PUBLICATIONS

Translation of WO-2021005195-A1. (Year: 2021).*
Translation of WO 2021005195 (Year: 2021).*

*Primary Examiner* — Adam J Waggenspack
(74) *Attorney, Agent, or Firm* — Squire Patent Consulting & IP Law LLC; Brendan E. Squire

(57) ABSTRACT

An apparatus and method for convenient and safe carriage of golf tees in a pocket or a mount point for a ball marker is disclosed. The golf tee tool includes an elongated channel dimensioned to receive a ground-penetrating tip and shaft of a golf tee. A fluted frustoconical opening at a proximal end of the golf tee tool is dimensioned to receive the cupped ball support of the golf tee. A magnet mounted at a distal end of the golf tee tool is configured to allow the golf tee tool to retrieve a ferrous ball marker from a putting green surface or the golfer's pocket. The golf tee tool may carry a single or multiple golf tees. The golf tee tool may provide for carriage of a divot repair tool and a ball marker. A clip assembly is also disclosed for coupling the golf tee tool to an article.

18 Claims, 37 Drawing Sheets

(56) References Cited

U.S. PATENT DOCUMENTS

| | | | | |
|---|---|---|---|---|
| 7,766,769 | B2 * | 8/2010 | Lueders | A63B 57/50 224/666 |
| 11,547,911 | B2 * | 1/2023 | Krauter | A63B 57/207 |
| 2004/0016787 | A1 * | 1/2004 | Loime | A45F 5/02 224/678 |
| 2006/0054647 | A1 * | 3/2006 | Kathrein | A45F 5/02 224/183 |
| 2006/0264267 | A1 * | 11/2006 | Fox | A63B 60/00 473/300 |
| 2007/0149325 | A1 * | 6/2007 | Vargas | A63B 57/353 473/286 |
| 2009/0209369 | A1 * | 8/2009 | Smith | A63B 57/10 224/183 |
| 2018/0193710 | A1 * | 7/2018 | Jernigan | A42B 1/24 |

* cited by examiner

GOLF TEE TOOL

CROSS-REFERENCE TO RELATED APPLICATION

This application claims the benefit of priority of U.S. provisional application No. 63/202,780, filed Jun. 24, 2021, and U.S. provisional application No. 63/265,383, filed Dec. 14, 2021, the contents of which are herein incorporated by reference.

BACKGROUND OF THE INVENTION

The present invention relates to golf accessories, and more particularly to tee holders and ball markers.

Golf tees can be difficult for the golfer to carry while playing golf. While bulk supplies of golf tees may be carried in a pocket of the golfer's club bag, the golfer will typically carry one or more tees on his or her person for more ready accessibility during a round of golf. Makeshift holders for golf tees include an external pleat or flap of the golf bag, tucking beneath the hatband of a cap, and the like. These makeshift locations are susceptible to the golfer losing the tee. Intended tee holders may include those found on a golf cart, including motorized carts and hand carts.

Despite all these options, many golfers prefer to carry their golf tees and ball markers in their pocket. The ball markers may be difficult to retrieve from the pocket, particularly when trying to distinguish from change and other items that may be carried in the golfer's pocket. With respect to the golf tees, the pointed ground-penetrating tips of the golf tee can cause discomfort or pain when the golf tee is carried in the golfer's pocket.

Once on the putting green, golfers will also utilize a ball marker to mark the position of their golf ball on the putting green. Heretofore, golfers would have to manually grasp the ball marker once they have placed their golf ball back on the putting green surface. Striking or touching of the ball once placed, may result in the golfer incurring a penalty stroke. Likewise, if the ball marker is placed in the golfer's pocket, it may be difficult to retrieve if the golfer also carries loose change in their pockets, as the ball marker may be otherwise indistinguishable from the coins.

As can be seen, there is a need for a tee holder that allows the golfer to safely carry one or more golf tees in his or her pocket and, an apparatus for retrieval of the ball marker from the green surface, which reduces the possibility of striking the golf ball is a desirable item, and for retrieval of a ball marker from the golfer's pocket.

SUMMARY OF THE INVENTION

In one aspect of the present invention, a golf tee tool is disclosed. The golf tee tool includes a body having a proximal end and a distal end. At least one channel is defined in a longitudinal length of the body. The at least one channel is dimensioned to removably receive a ground penetrating tip and a shaft of a golf tee through an opening at the proximal end of the body. A magnet is disposed at the distal end of the body.

In some embodiments, the opening is a fluted frusto conical opening dimensioned to receive a ball holding cup of the golf tee.

In some embodiments, the golf tee is received in the channel with an interference fit.

In some embodiments, the at least one channel includes a first channel and a second channel. The body includes a plate having a front face and a back face, with the plate disposed between the first channel and the second channel.

In some embodiments, a receiver is provided on the plate. The receiver is configured to releasably retain a ball marker. A second magnet may be carried in at least one of the front face and the back face of the plate. The second magnet is configured to magnetically retain a ferrous ball marker. In some embodiments, the receiver is an arcuate ridge that protrudes from at least one of the front face and the back face of the plate. The arcuate ridge defines a slot dimensioned to retain the ball marker. A lip extends from the arcuate ridge and is configured to abut with a face of the ball marker when the ball marker is received in the slot.

In some embodiments, a tab protrudes into the slot. The tab is configured to urge the front face of the ball marker in abutment with the lip when the ball marker is received in the slot. In some embodiments, the tab is resiliently disposed on the plate.

In some embodiments, the golf tee tool may also include one or more ridges protruding from one of the front face and the back face of the body. The one or more ridges configured for removably receiving a divot tool in a snap-fit engagement with the body. The one or more ridges may engage with an outer edge of spaced apart legs of the divot tool.

In some embodiments, a recess is defined in the plate. The recess is dimensioned to receive the golf tee at an intermediate position of the body. A ridge may extend along a length of the recess for retaining the golf tee in a snap-fit relation.

In yet other embodiments, the golf tee tool may also include a retaining clip having a proximal end and a distal end. A retaining hook is provided at the distal end. A retaining clip magnet is provided at the proximal end of the retaining clip and is configured to magnetically couple with the magnet at the distal end of the body.

These and other features, aspects, and advantages of the present invention will become better understood with reference to the following drawings, description and claims.

DETAILED DESCRIPTION

Figure 1:
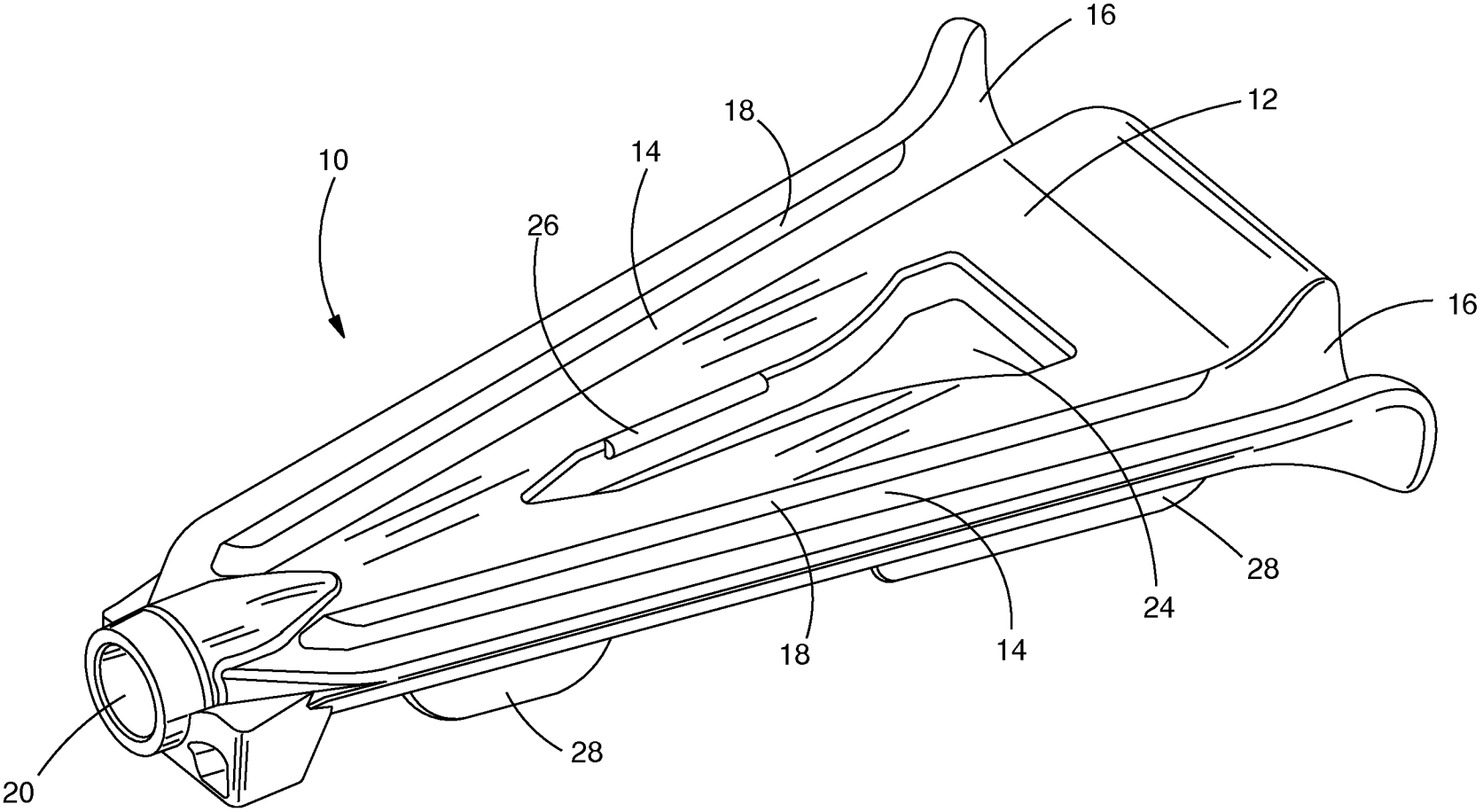
FIG. 1 is a top perspective view of a first embodiment of a golf tee tool.
Figure 2:
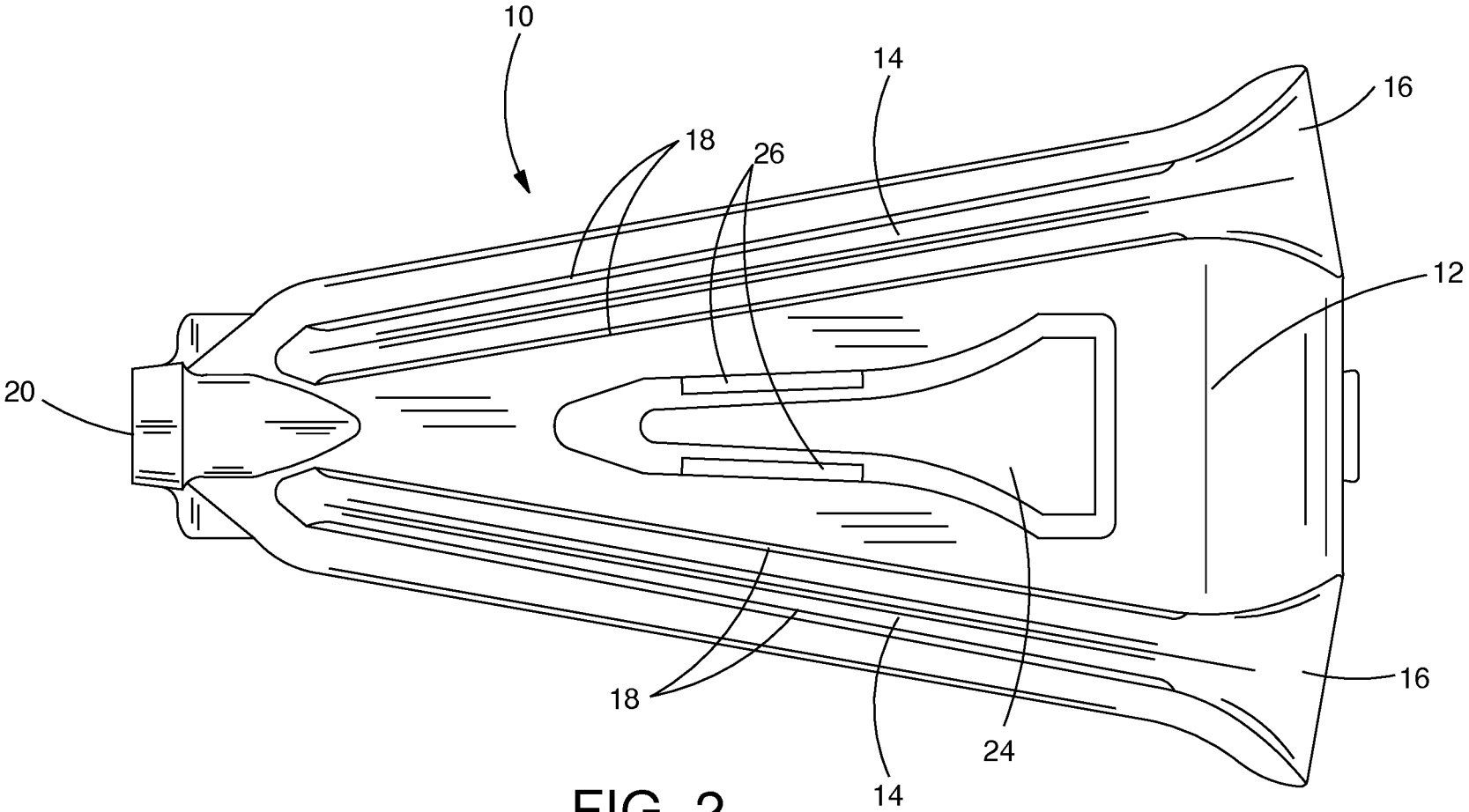
FIG. 2 is a top plan view of the first embodiment of the golf tee tool.
Figure 3:
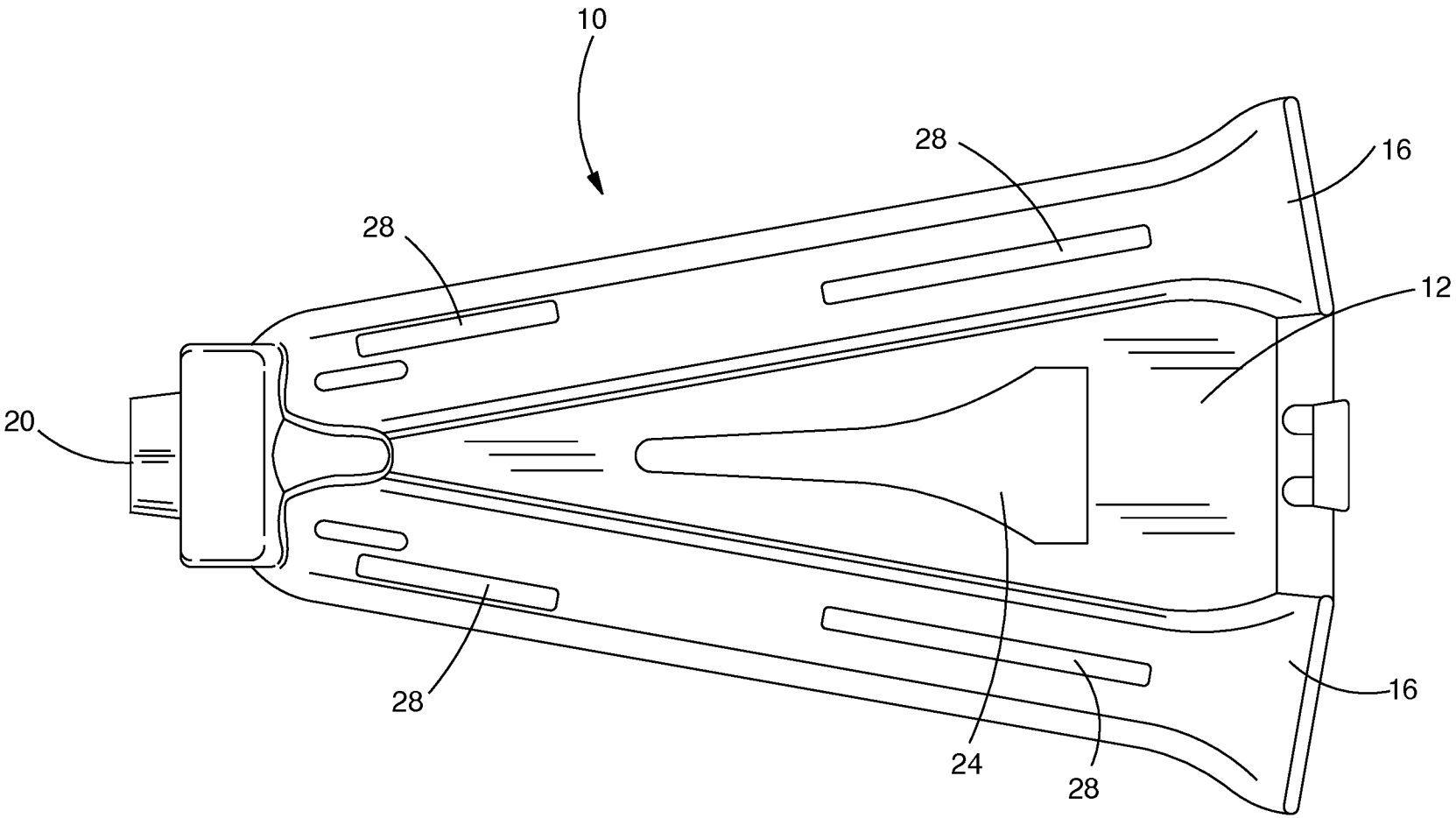
FIG. 3 is a bottom plan view of the first embodiment of the golf tee tool.
Figure 4:
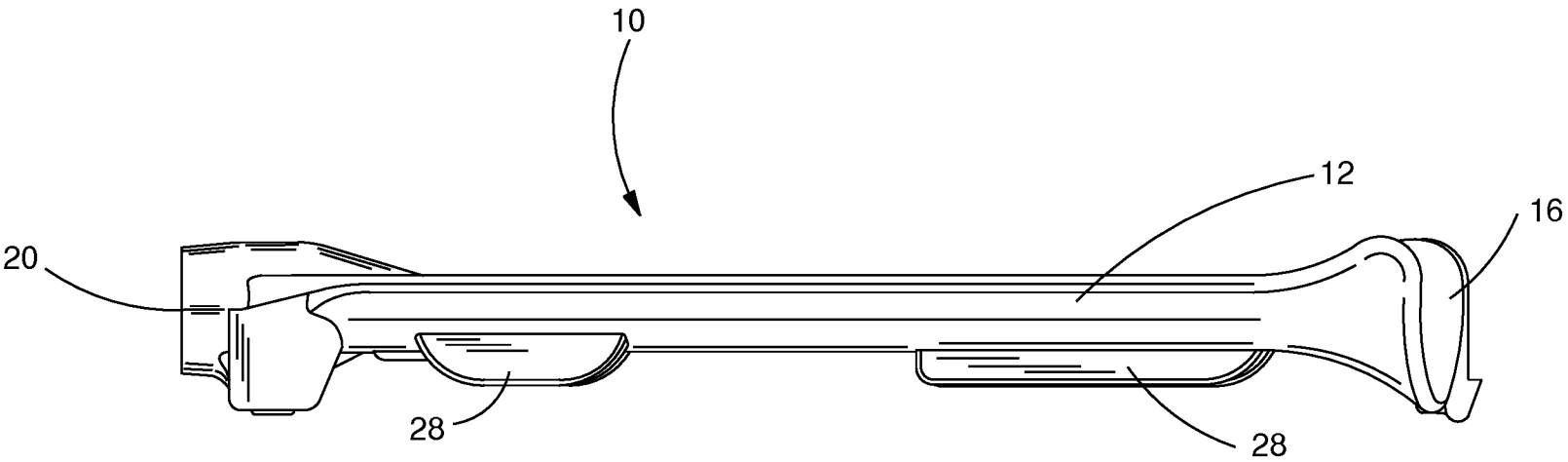
FIG. 4 is a left side elevation view of the first embodiment of the golf tee tool.
Figure 5:
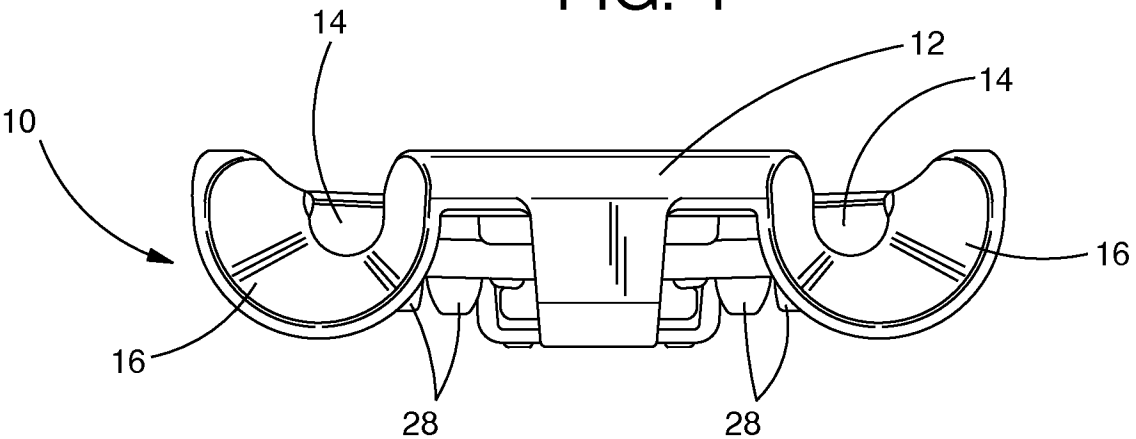
FIG. 5 is a rear elevation view of the first embodiment of the golf tee tool.
Figure 6:
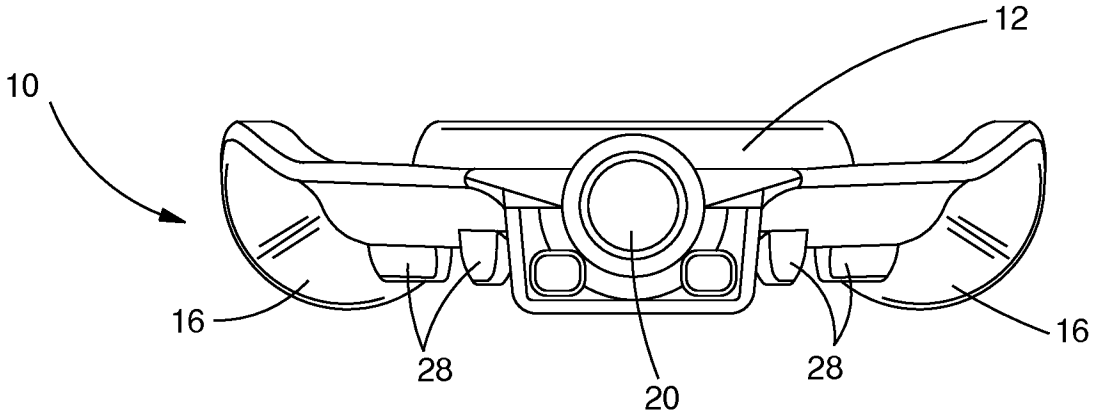
FIG. 6 is a front elevation view of the first embodiment of the golf tee tool.
Figure 7:
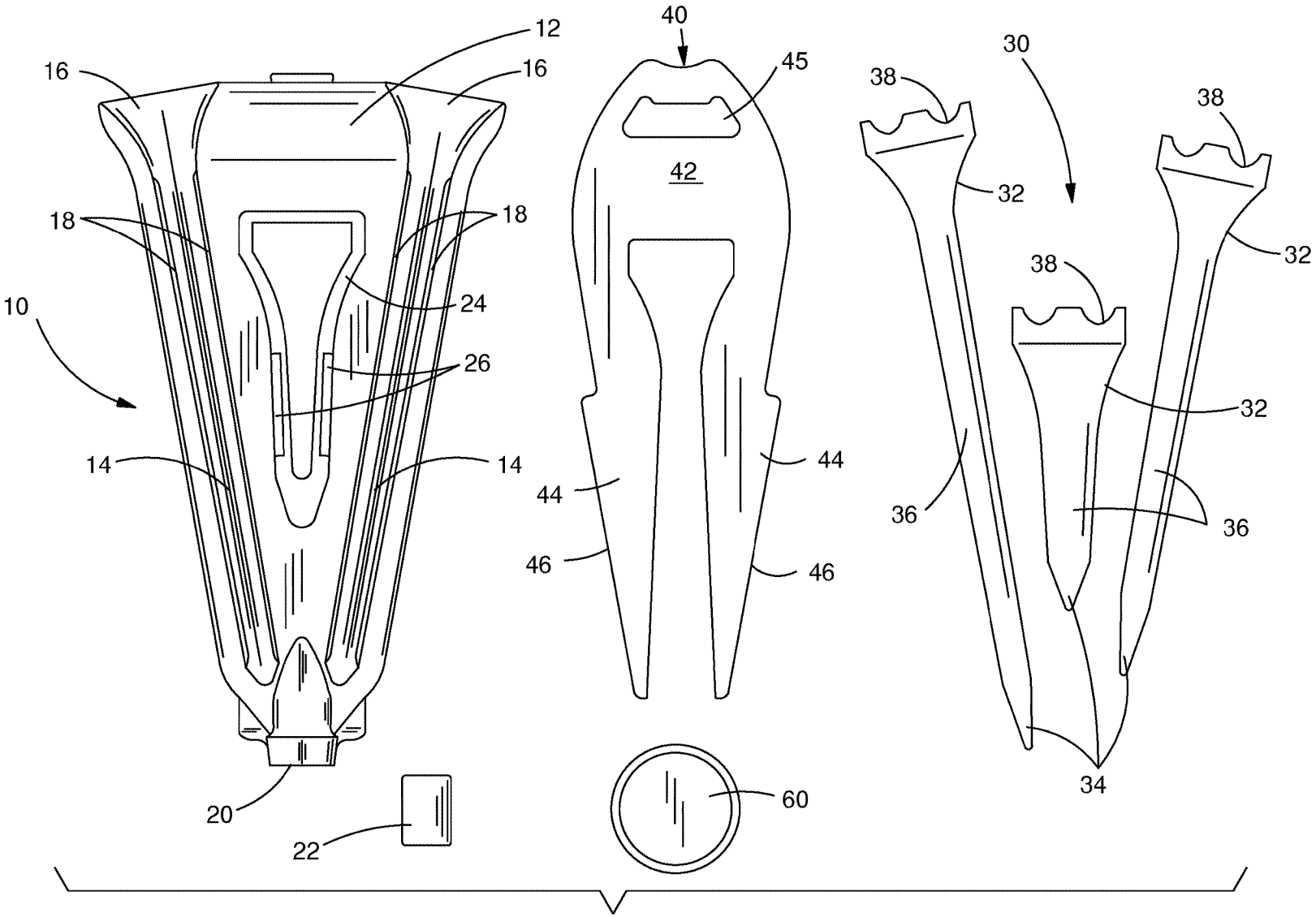
FIG. 7 is an exploded view of the first embodiment of the golf tee tool, with accompanying golf accessories that may be utilized with the golf tee tool.
Figure 8A:
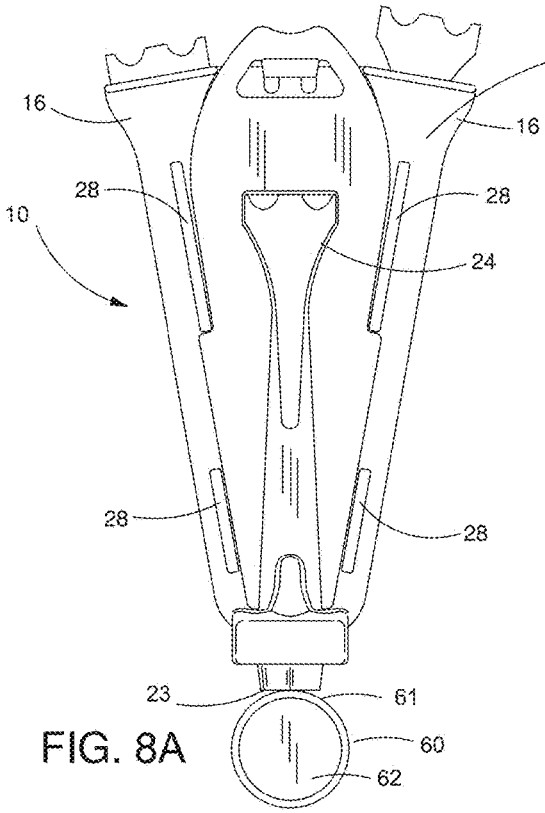
FIG. 8A is a top plan view of the first embodiment of the golf tee tool, shown in use with the accompanying golf accessories with the ball mark magnetically connected in a first orientation
Figure 8B:
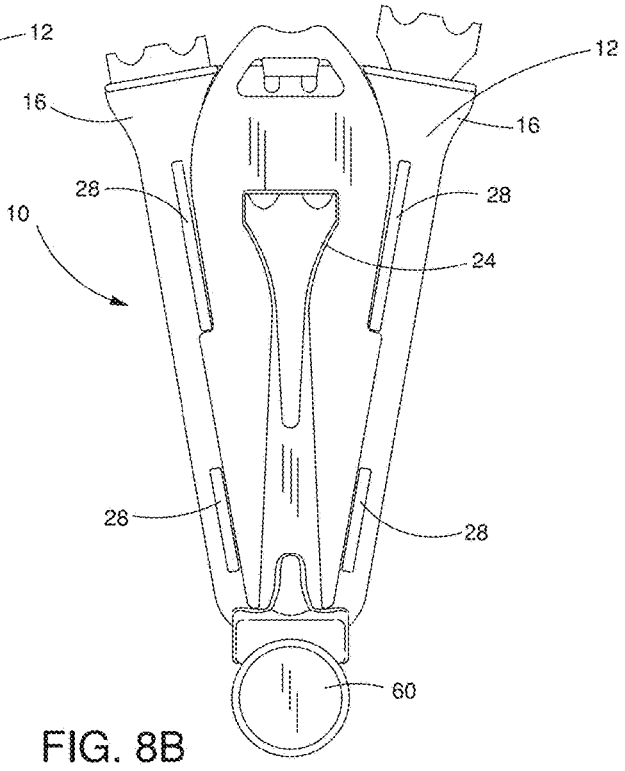
FIG. 8B is a top plan view of the first embodiment of the golf tee tool, shown in use with the ball mark magnetically connected in a second orientation.
Figure 9:
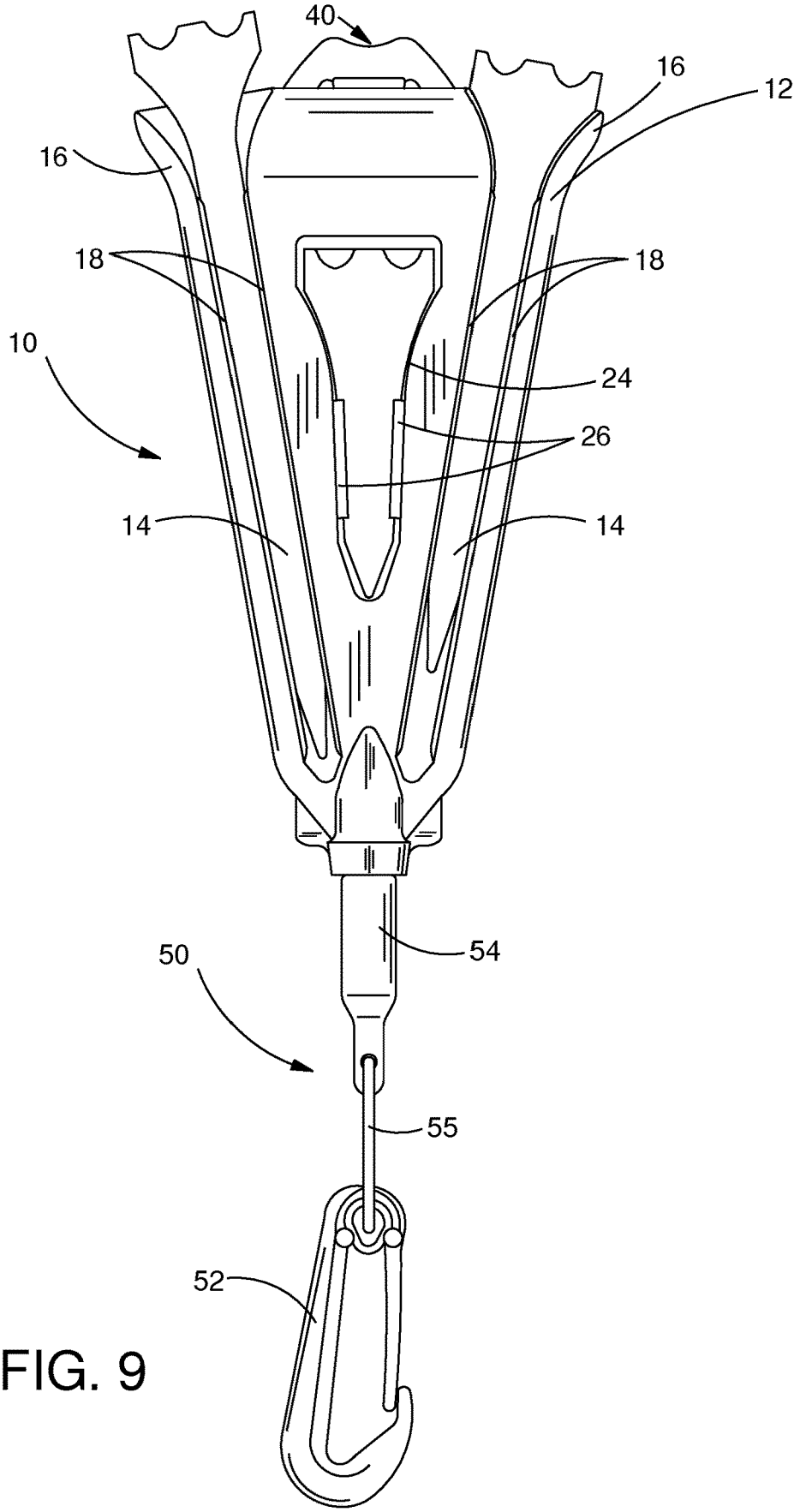
FIG. 9 is a top plan view of the first embodiment of the golf tee tool, shown in use with the accompanying golf accessories, shown with an optional magnetic retention clip.
Figure 10:
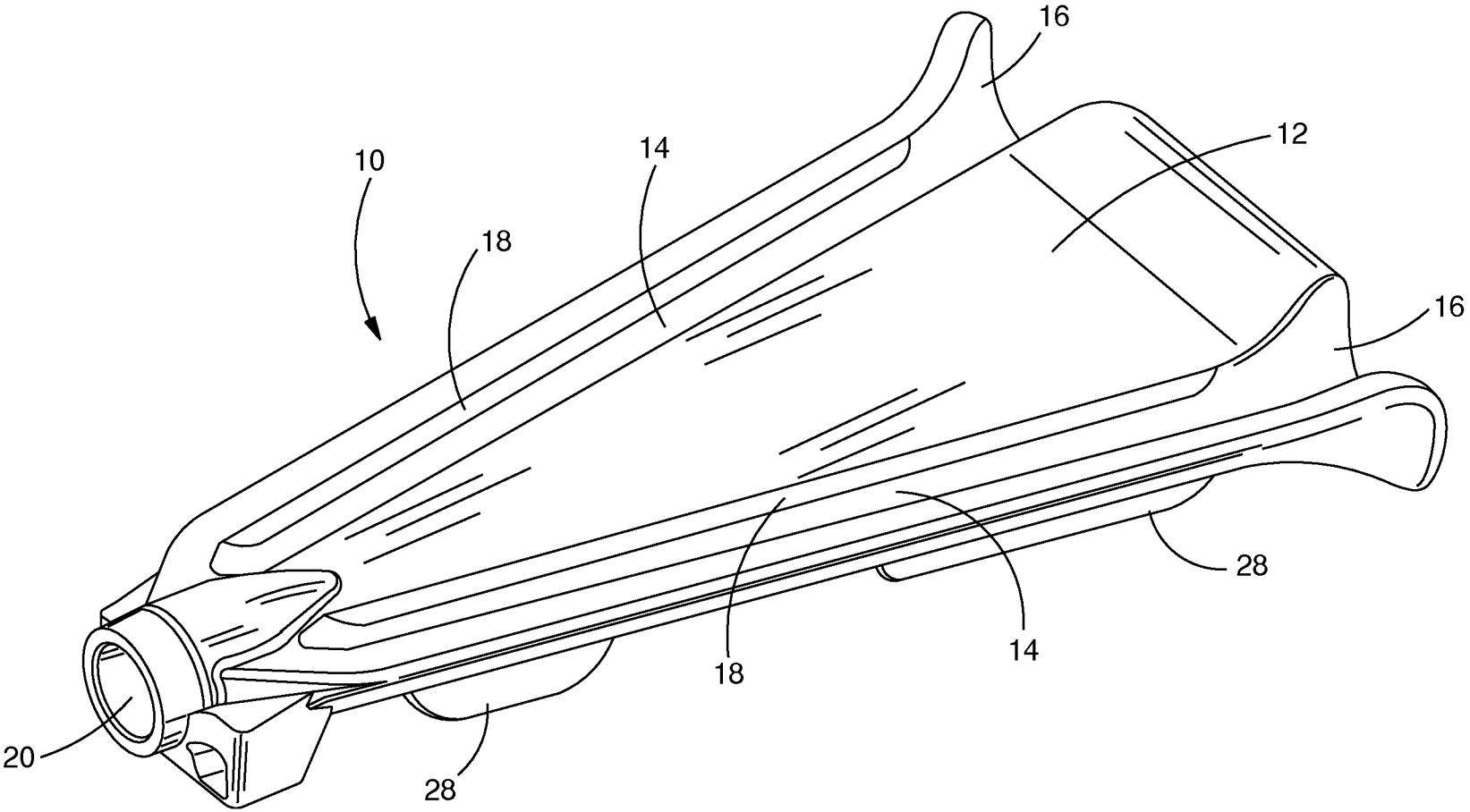
FIG. 10 is a top perspective view of a second embodiment of a golf tee tool.
Figure 11:
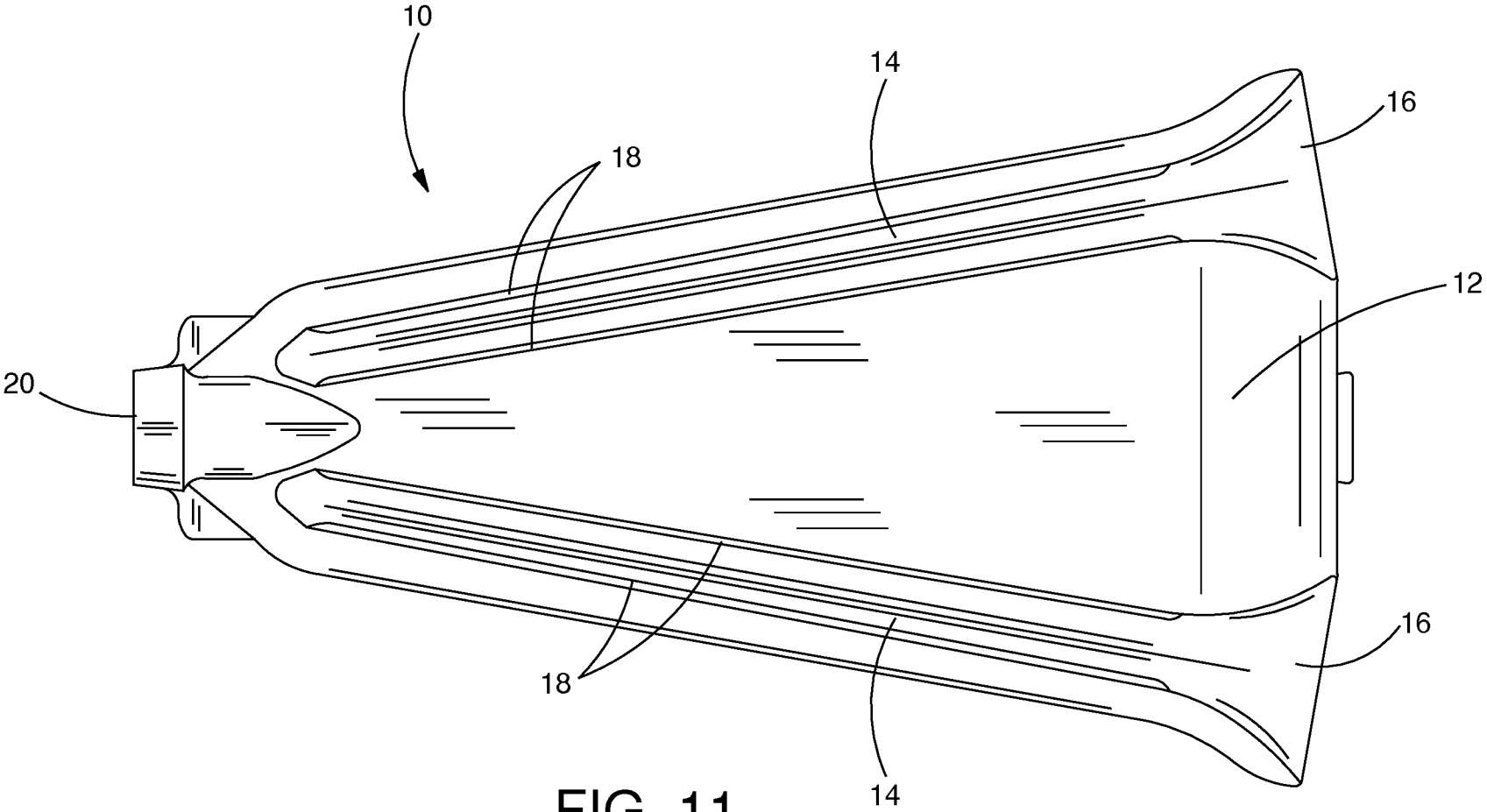
FIG. 11 is a top plan view of the first embodiment of the second embodiment of the golf tee tool.

The following detailed description is of the best currently contemplated modes of carrying out exemplary embodiments of the invention. The description is not to be taken in a limiting sense but is made merely for the purpose of illustrating the general principles of the invention.

Broadly, embodiments of the present invention provide a golf tee tool for conveniently carrying one or more golf tees. Alternatively, or in addition, the golf tee tool may also conveniently carry a ball marker with provisions for retrieving the ball marker without risk of touching or striking a golf ball, once placed on a surface of a putting green, or retrieval of the ball marker from the golfer's pocket. In yet other embodiments, the golf tee tool may include a clip for retaining the golf tee tool.

As seen in reference to the drawings of FIGS. 1-34, non-limiting embodiments of the golf tee tool 10 of the present invention include an elongated sleeve having a proximal end and a distal end. The elongated sleeve has a channel 14 extending from the proximal end to the distal end. The channel 14 is dimensioned to receive a ground-penetrating tip 34 and a shaft 36 of a golf tee 30, preferably with an interference fit.

The proximal end of the channel 14 may have a fluted frusto conical opening 16 that is dimensioned to receive a ball-holding cup 32 of the golf tee 30. The elongated sleeve may be made of a rigid, semi-rigid, or resilient material, such as metal, plastics, rubber, composites, and the like. When the channel 14 is opened along a longitudinal length, the shaft 36 and ground-penetrating tip 34 of the golf tee 30 may be snap fitted laterally into the channel 14, and retained by a ridge 18 protruding into an opening of the channel 14. The channel may 14 also have a space to accommodate a rib or protrusion from the tee shaft 36. The rib or protrusion is defined at an intermediate portion of the tee shaft 36 to provide a predetermined tee elevation of the ball above the ground surface of the tee box.

In the embodiments shown in FIGS. 1-25, multiple channels 14 may be provided in a splayed orientation relative to a body 12 of the golf tee tool 10, with the multiple channels 14 converging towards the distal end of the golf tee tool 10. A gripping plate 15 may be disposed between each of the multiple channels 14.

A magnet 22 may be coupled with the distal end of the golf tee tool 10. The magnet 22 is oriented to retrieve and attract a ferrous ball marker 60 via a magnetic attraction. The magnet 22 may be received in a receptacle 20 defined at the distal end of the golf tee tool. As seen in reference to FIGS. 8A, 8B, 17A, 17B, 26A, 26B, 35A, 35B, 43A, 43B, and 43C, the magnet 22 may magnetically couple with the ferrous ball marker 60 in various orientations. In a first orientation, a side edge 61 of the ferrous ball marker 60 may couple with an end face 23 of the magnet 22. In a second orientation, a face 62 of the ferrous ball marker 60 may magnetically couple with a flattened side surface 13 of the distal end of the body 12 of the golf tee tool 10. In a third orientation, the face 62 of the ferrous ball marker 60 may magnetically couple with the end face 23 of the magnet 22. In use, the golfer may manipulate the ferrous ball marker 60 as a fidget in connection with the body 12 between each of the first orientation, the second orientation, and the third orientation.

In use, the golfer would hold the proximal end of the golf tee tool 10 and advance the distal end carrying the magnet 22 towards the ferrous ball marker 60. When the ferrous ball marker 60 has been attracted to and retained with the magnet 22, the golfer may retrieve the golf tee tool 10 and ferrous ball marker 60 from the putting green surface. Additionally, by placing the magnetic tip 22 into the golfer's pocket, the ferrous ball marker 60 may be retrieved from the golfer's pocket by the magnet 22, allowing the ferrous ball marker 60 to be readily segregated from loose coins that the golfer may be carrying in their pocket.

In some embodiments, the magnet 22 may be a cylindrical magnet 22 transversely mounted at the distal end of the golf tee tool 10. The cylindrical magnet 22 may be rotationally carried between opposed support arms disposed at the distal end of the golf tee tool 10. The rotation of the magnet 22 may provide a fidget for the golfer to rotate. In other embodiments, the magnet 22 may be coupled with the distal end of the golf tee tool 10. In the non-limiting embodiments shown, the magnet 22 may be received within a receptacle 20 disposed at the distal end of the golf tee tool 10.

Figure 12:
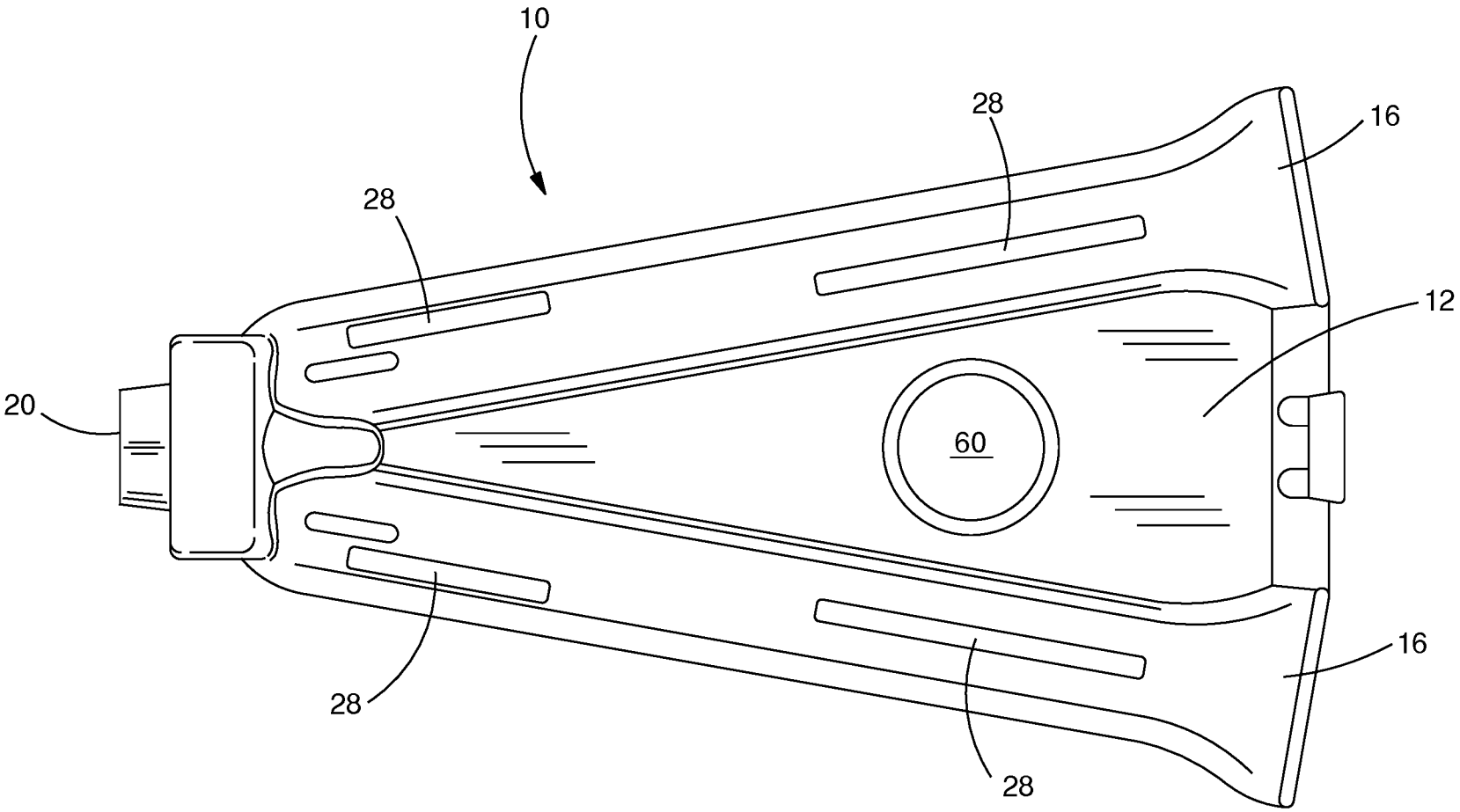
FIG. 12 is a bottom plan view of the second embodiment of the golf tee tool.
Figure 13:
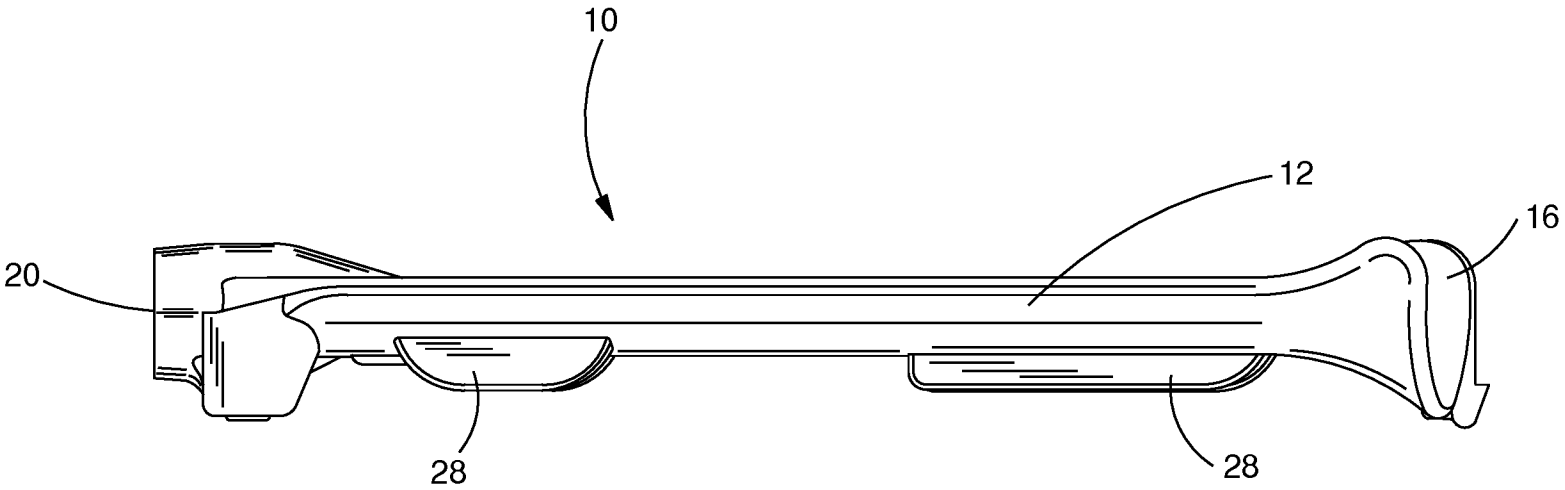
FIG. 13 is a left side elevation view of the second embodiment of the golf tee tool.
Figure 14:
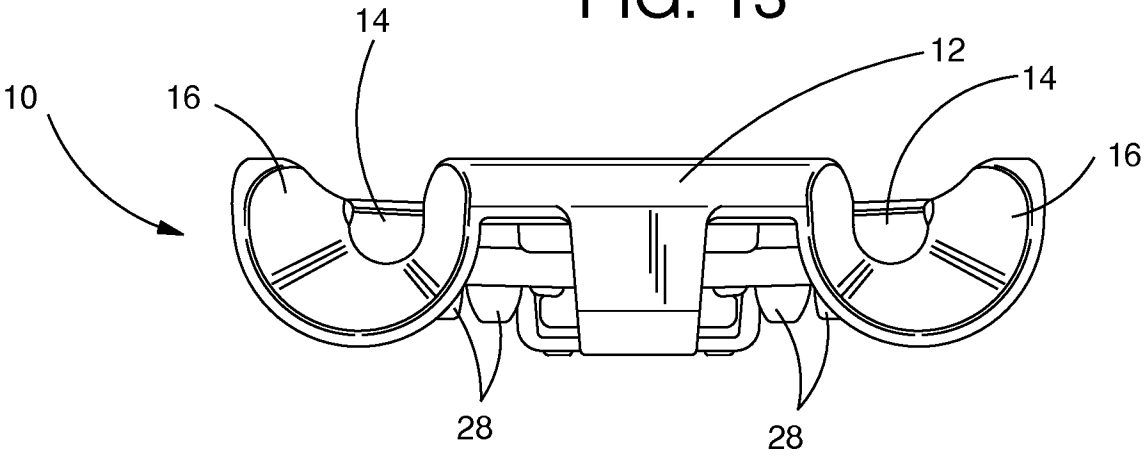
FIG. 14 is a rear elevation view of the second embodiment of the golf tee tool.
Figure 15:
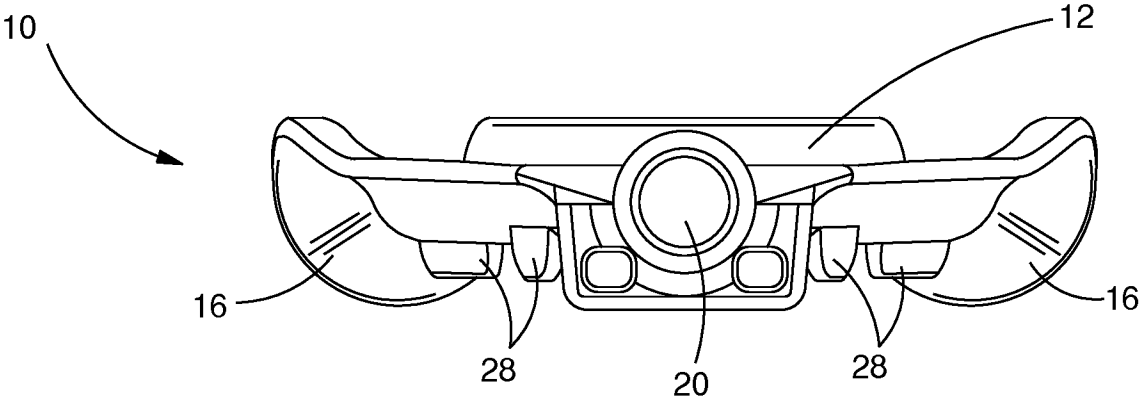
FIG. 15 is a front elevation view of the second embodiment of the golf tee tool.
Figure 16:
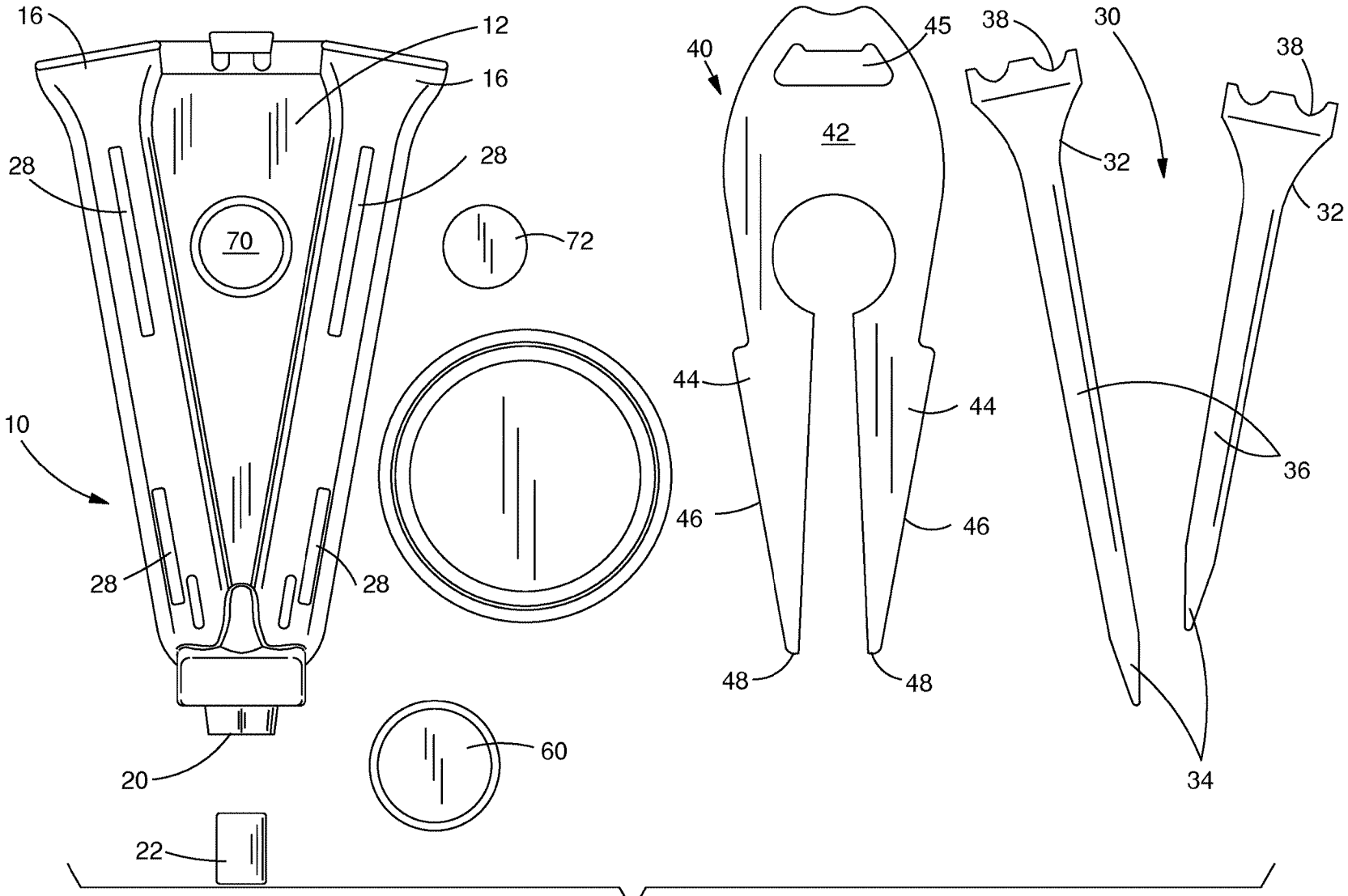
FIG. 16 is an exploded view of the second embodiment of the golf tee tool, with accompanying golf accessories that may be utilized with the golf tee tool.
Figure 17A:
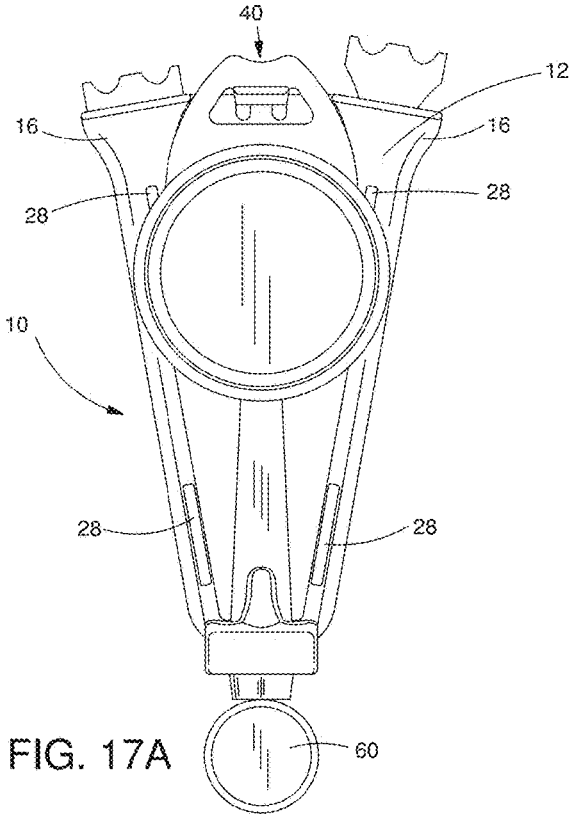
FIG. 17A is a top plan view of the second embodiment of the golf tee tool, shown in use with the accompanying golf accessories with the ball mark magnetically connected in a first orientation
Figure 17B:
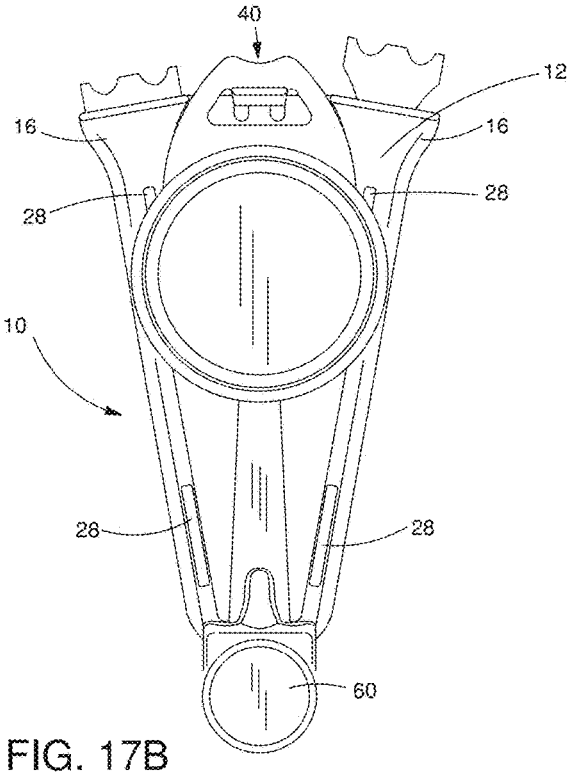
FIG. 17B is a top plan view thereof, shown in use with the ball mark magnetically connected in a second orientation.
Figure 18:
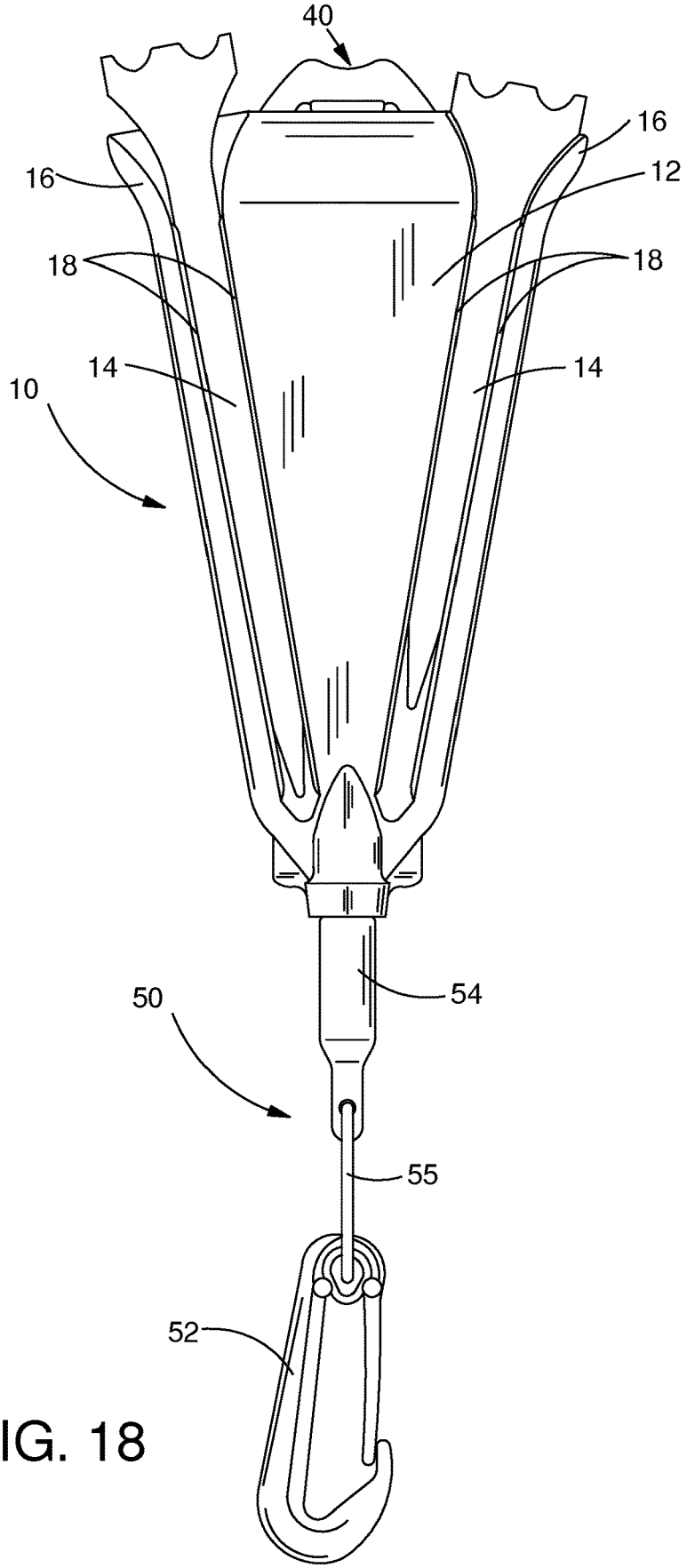
FIG. 18 is a top plan view of the second embodiment of the golf tee tool, shown in use with the accompanying golf accessories, shown with an optional magnetic retention clip.
Figure 19:
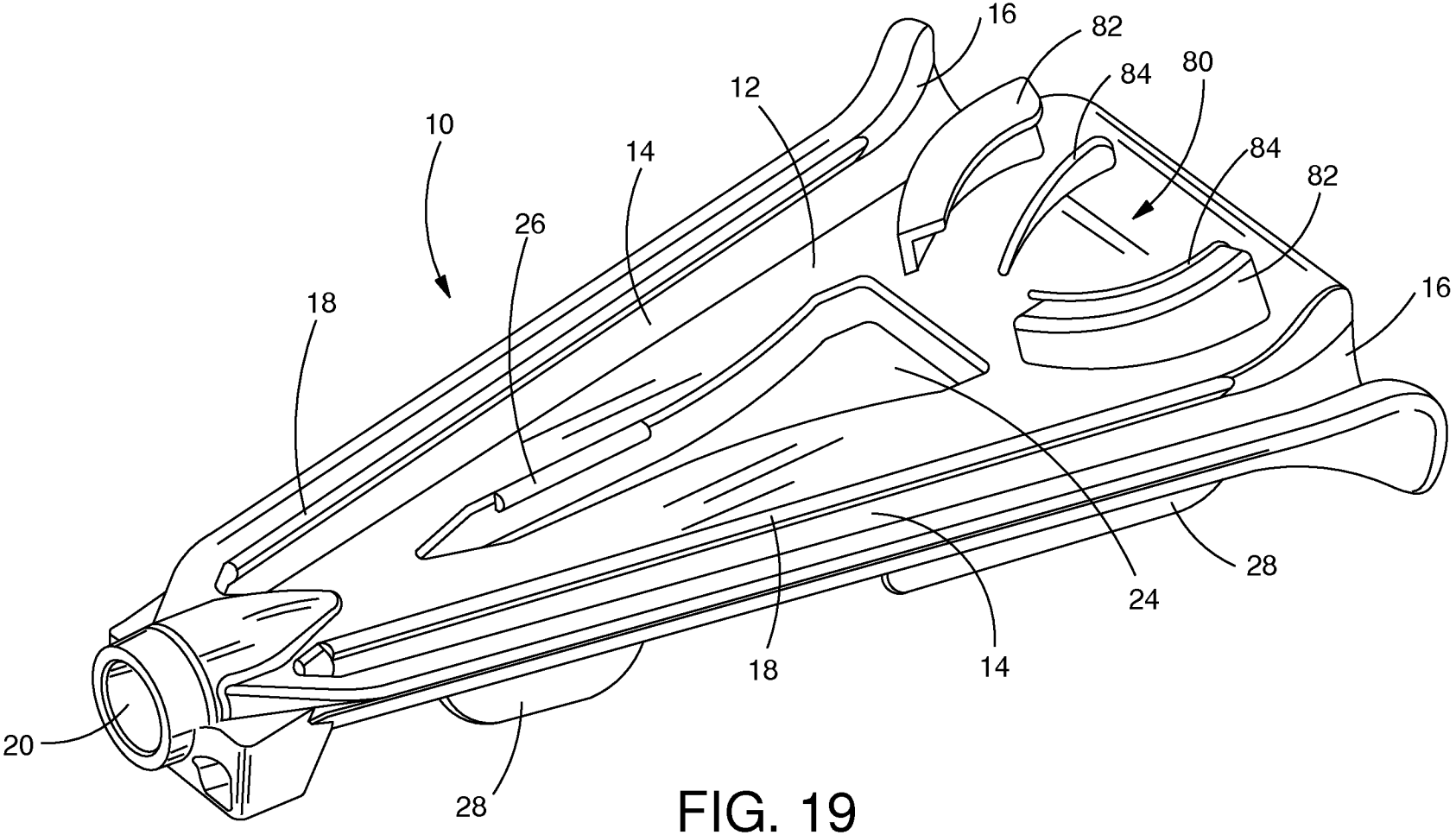
FIG. 19 is a top perspective view of a third embodiment of a golf tee tool.
Figure 20:
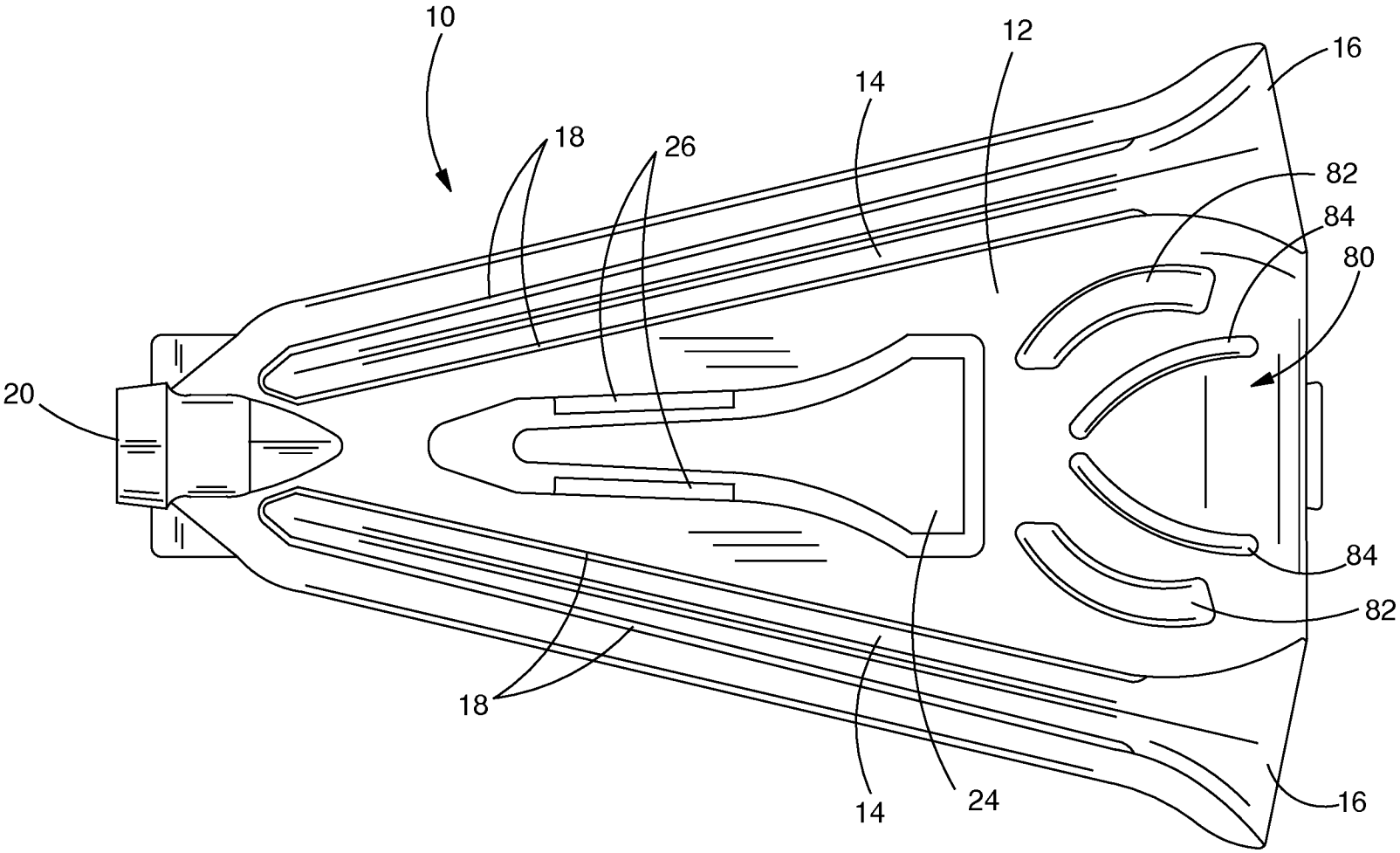
FIG. 20 is a top plan view of the third embodiment of the golf tee tool.
Figure 21:
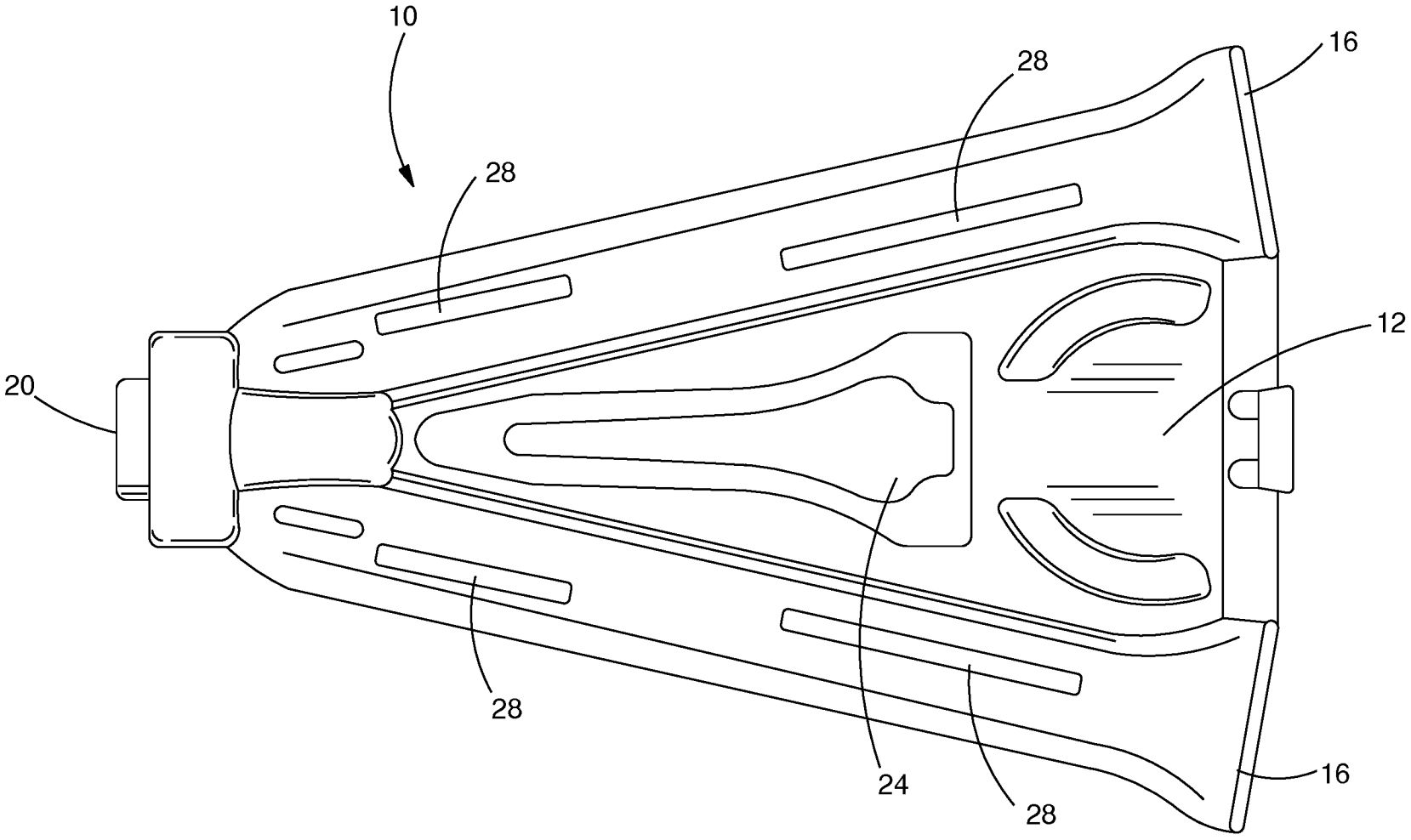
FIG. 21 is a bottom plan view of the third embodiment of the golf tee tool.
Figure 22:
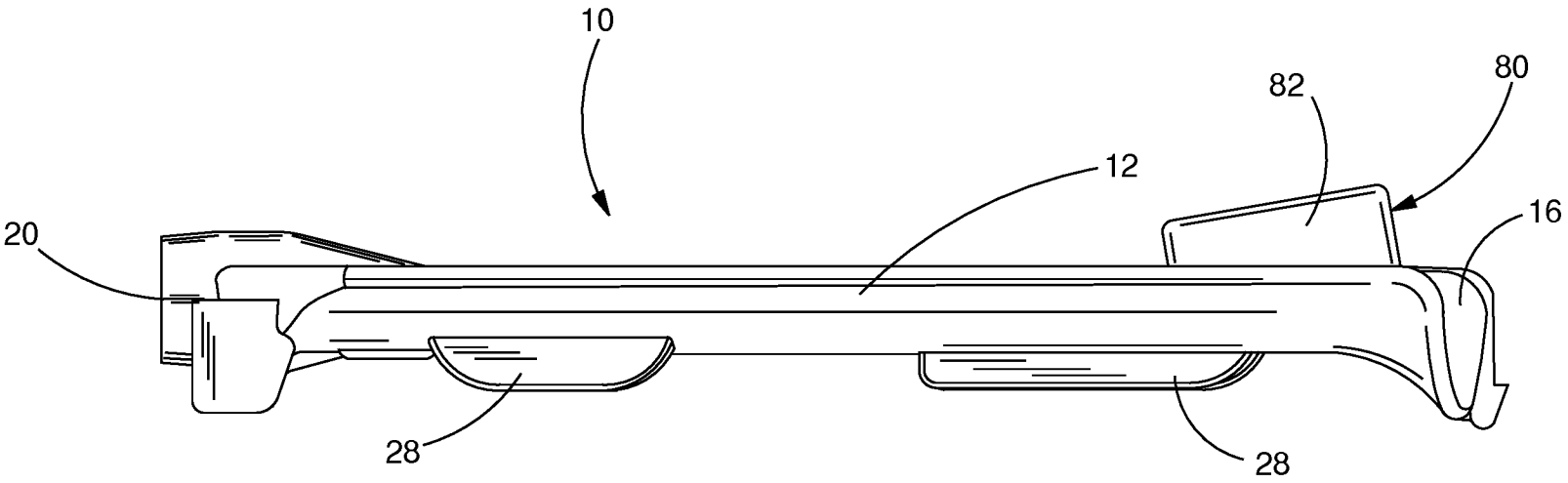
FIG. 22 is a left side elevation view of the third embodiment of the golf tee tool.
Figure 23:
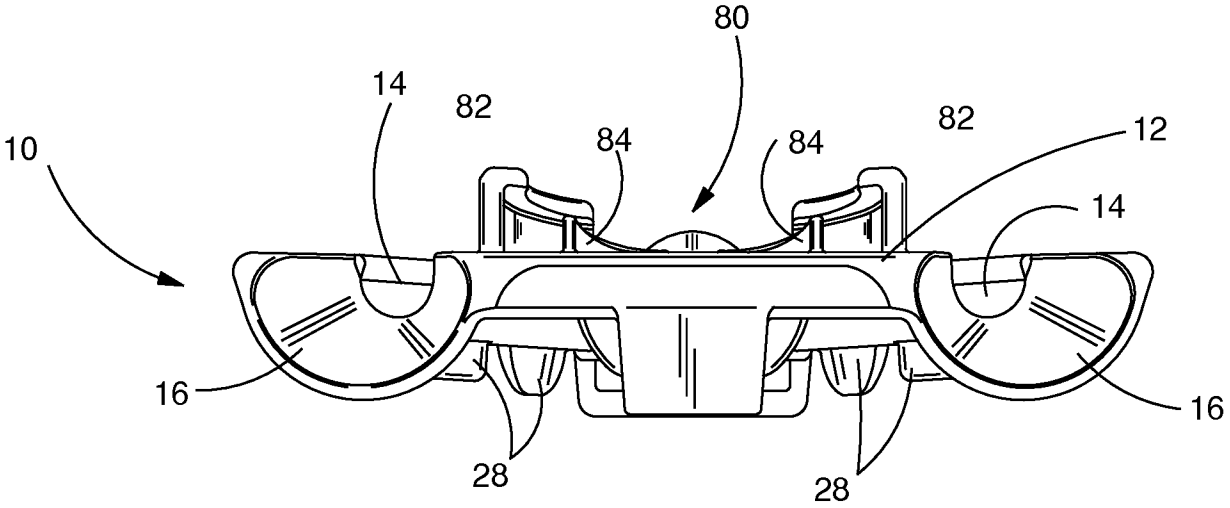
FIG. 23 is a rear elevation view of the third embodiment of the golf tee tool.
Figure 24:
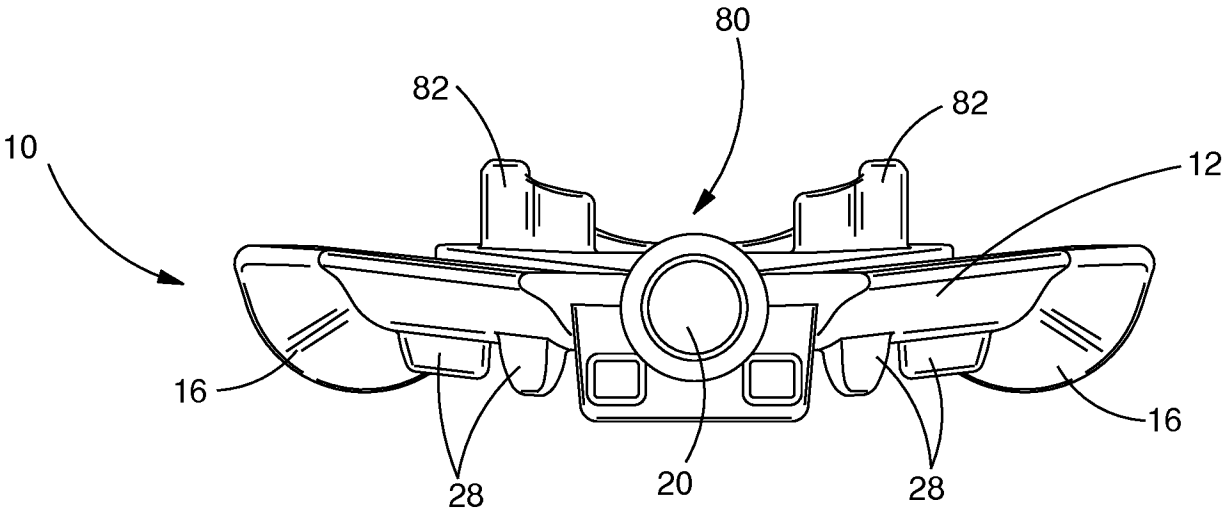
FIG. 24 is a front elevation view of the third embodiment of the golf tee tool.
Figure 25:
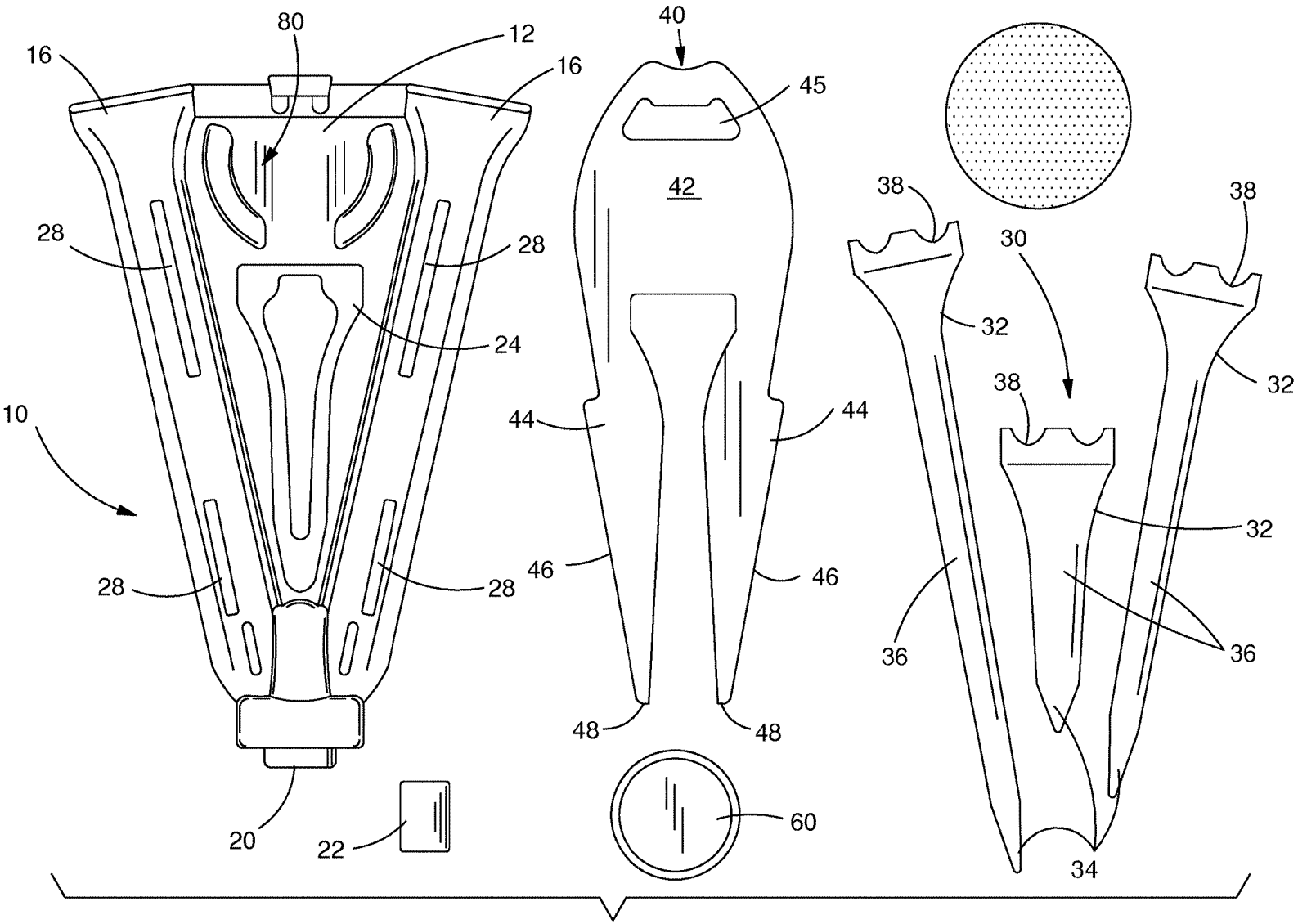
FIG. 25 is an exploded view of the third embodiment of the golf tee tool, with accompanying golf accessories that may be utilized with the golf tee tool.
Figure 26A:
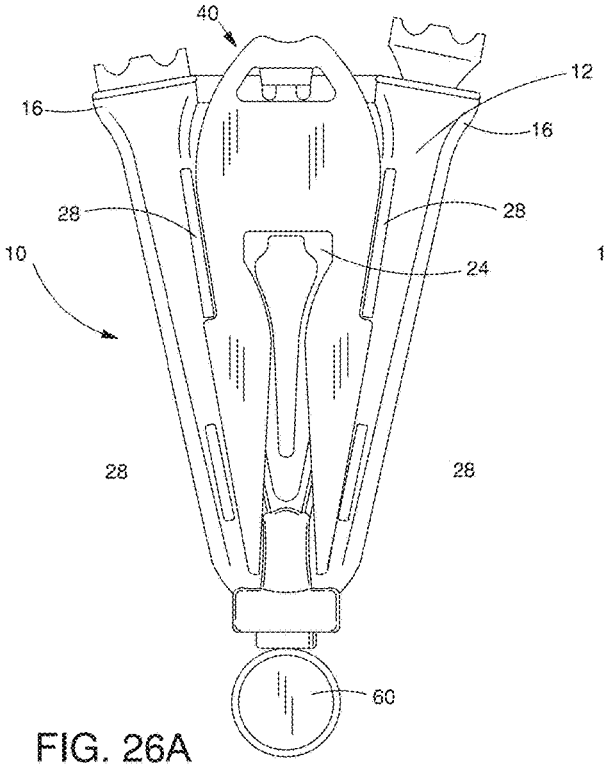
FIG. 26A is a top plan view of the third embodiment of the golf tee tool, shown in use with the accompanying golf accessories with the ball mark magnetically connected in a first orientation
Figure 26B:
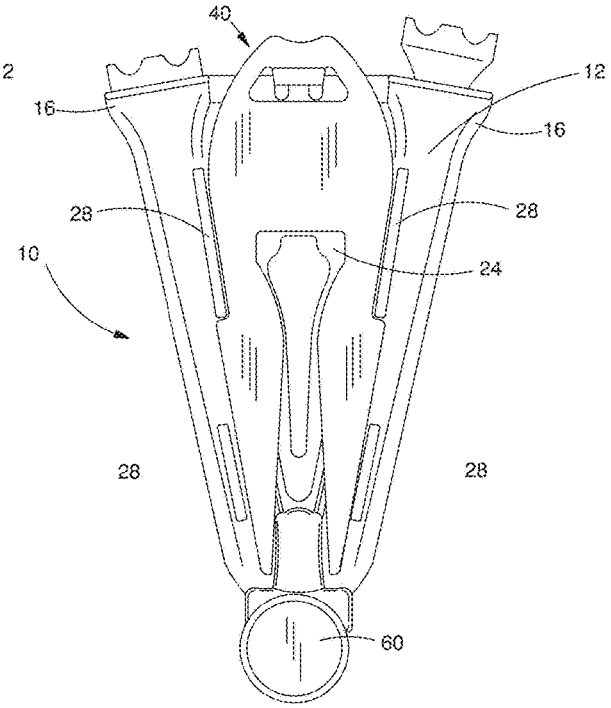
FIG. 26B is a top plan view thereof, shown in use with the ball mark magnetically connected in a second orientation.
Figure 27:
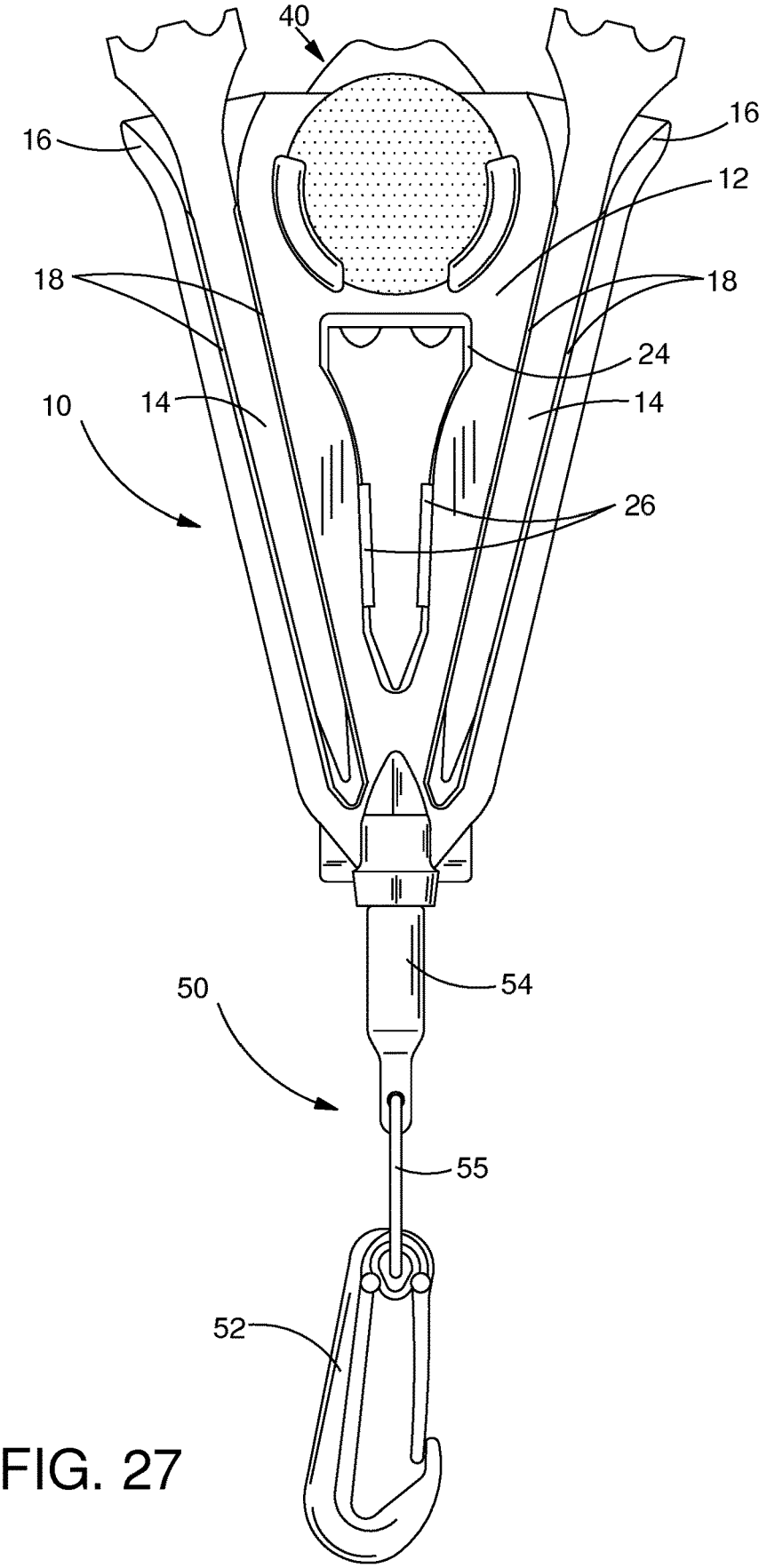
FIG. 27 is a top plan view of the third embodiment of the golf tee tool, shown in use with the accompanying golf accessories, shown with an optional magnetic retention clip.
Figure 28:
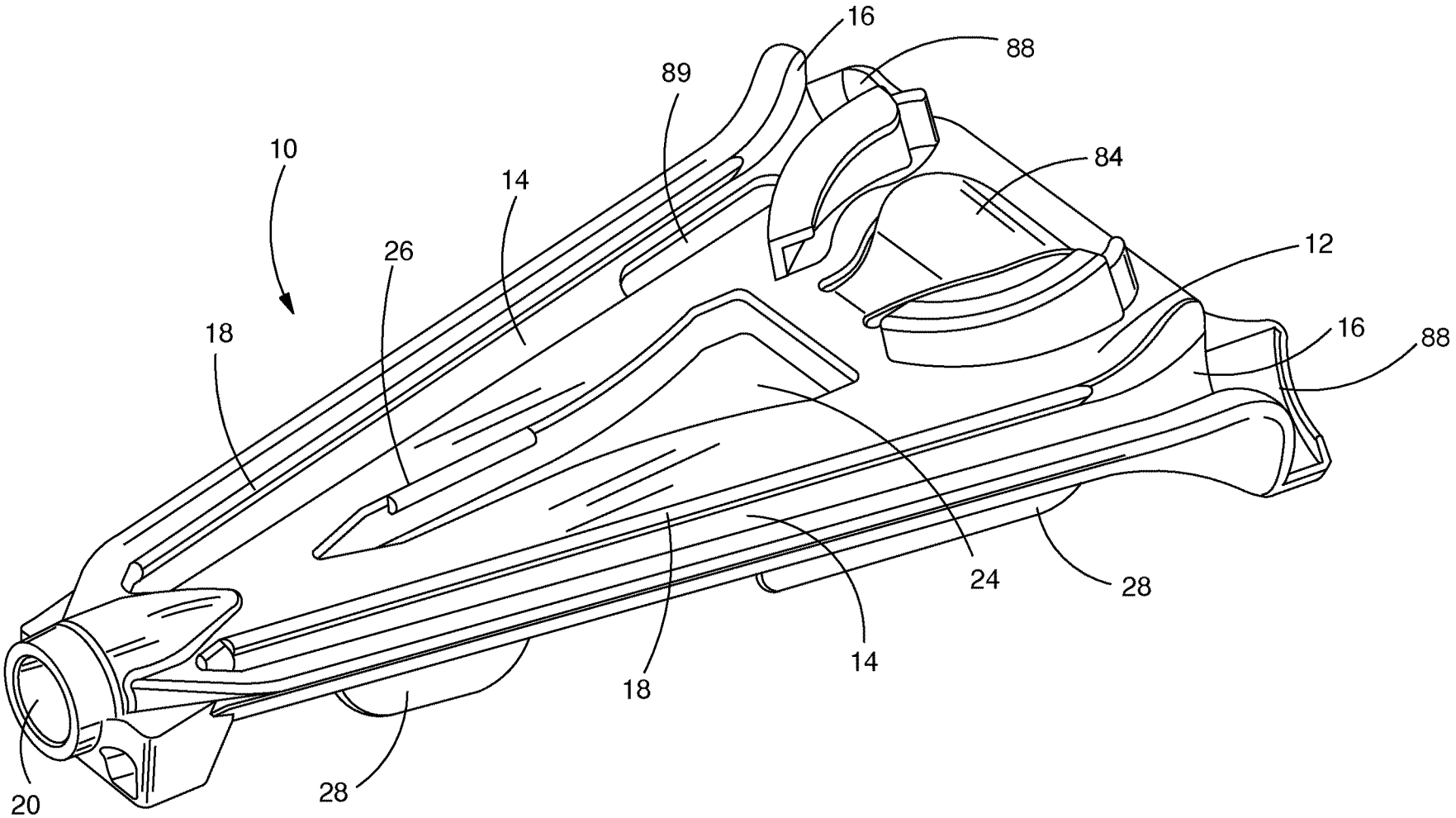
FIG. 28 is a top perspective view of a fourth embodiment of a golf tee tool.
Figure 29:
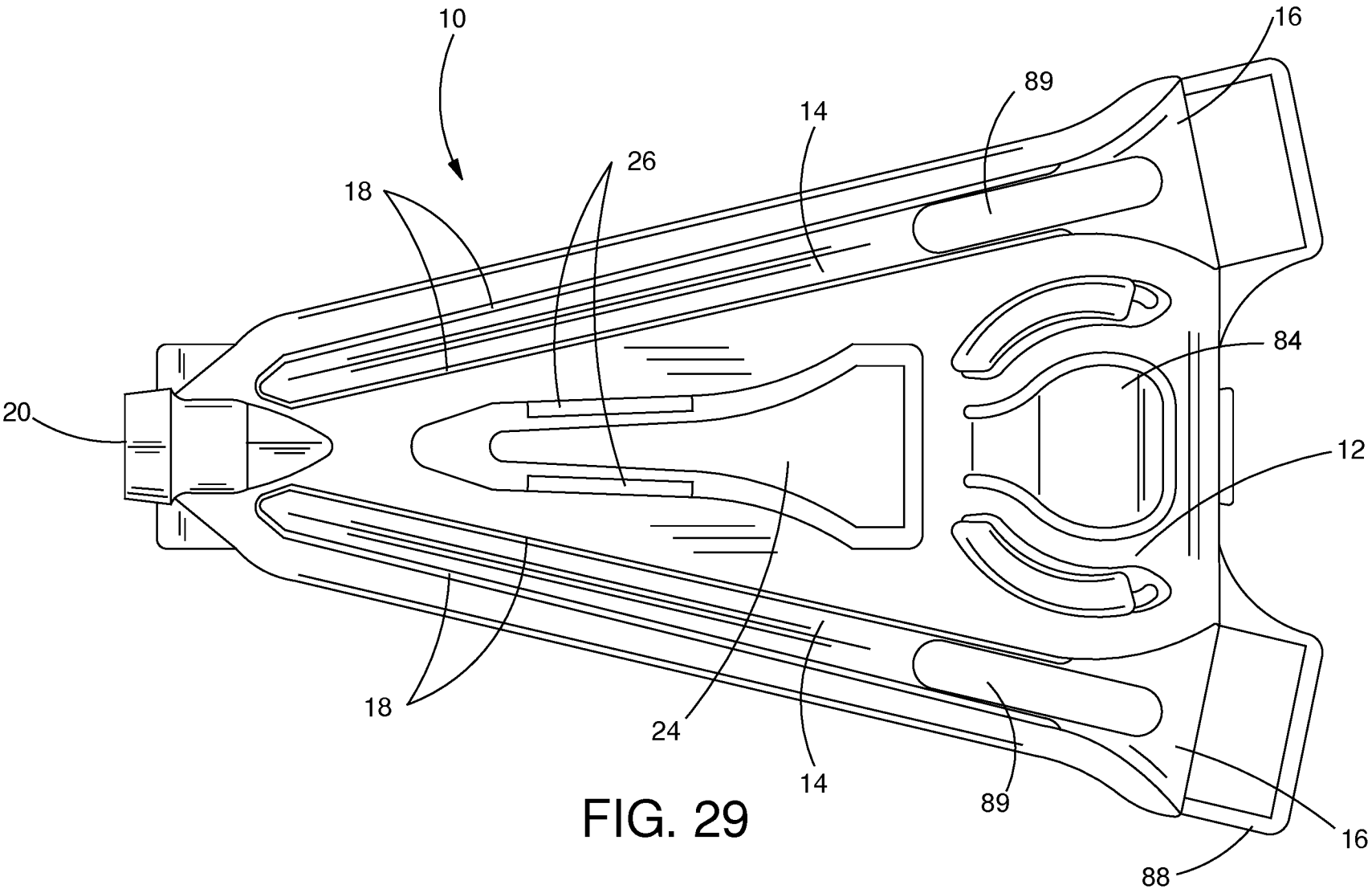
FIG. 29 is a top plan view of the fourth embodiment of the golf tee tool.
Figure 30:
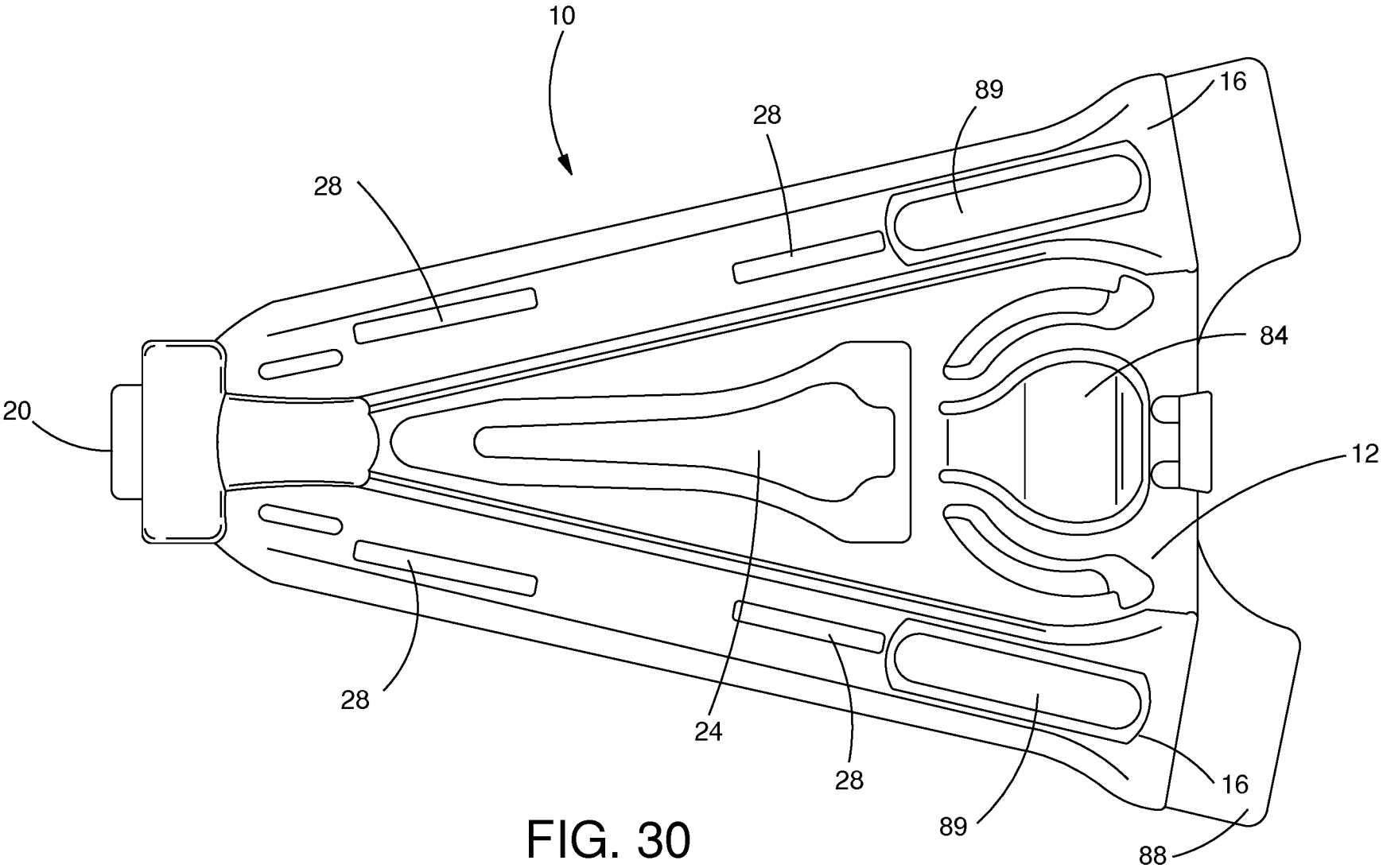
FIG. 30 is a bottom plan view of the fourth embodiment of the golf tee tool.
Figure 31:
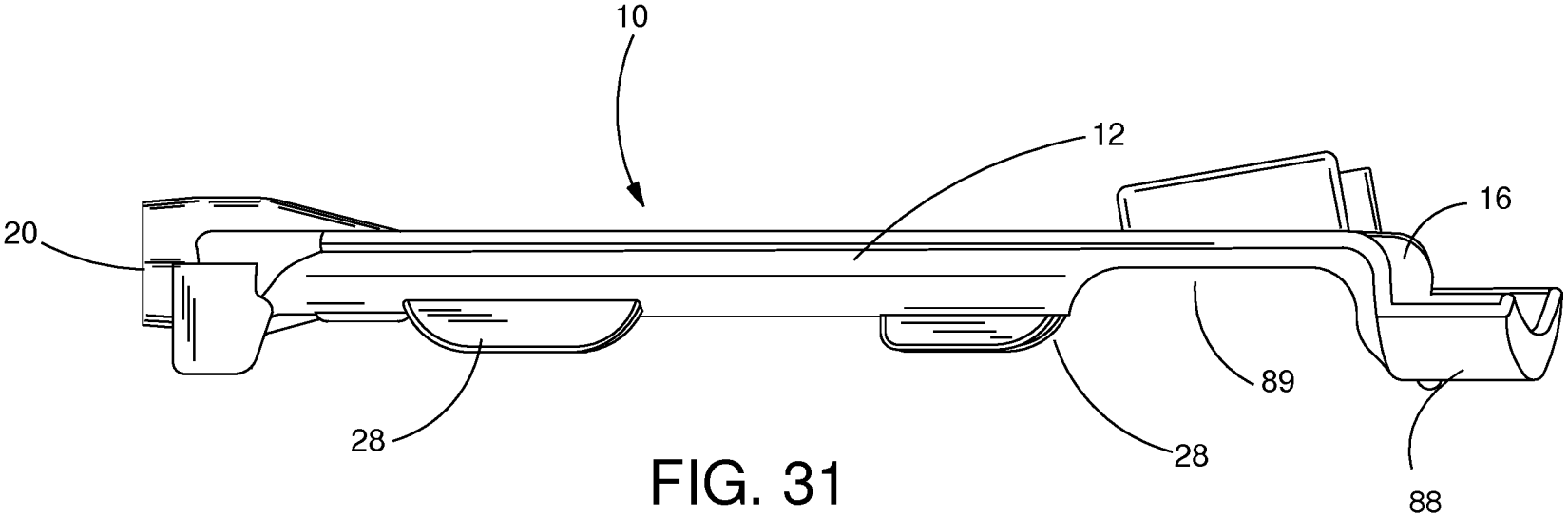
FIG. 31 is a left side elevation view of the fourth embodiment of the golf tee tool.
Figure 32:
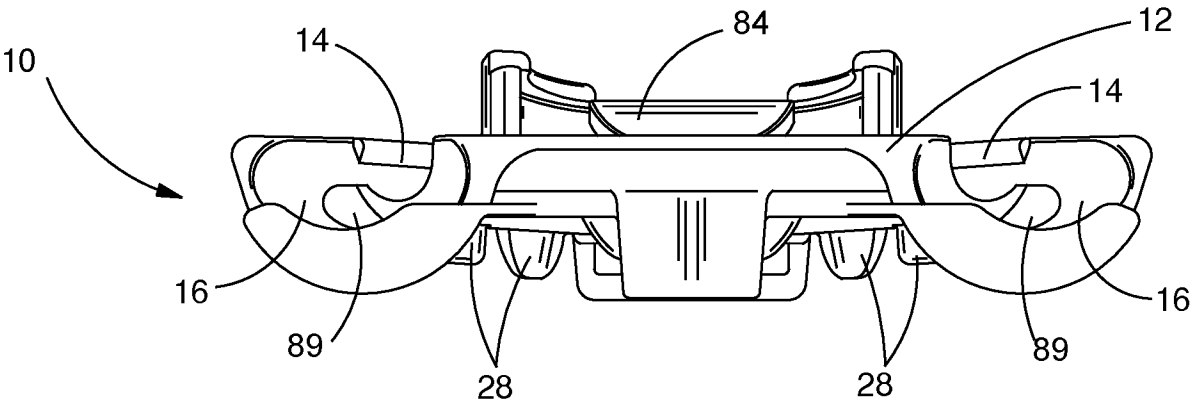
FIG. 32 is a rear elevation view of the fourth embodiment of the golf tee tool.
Figure 33:
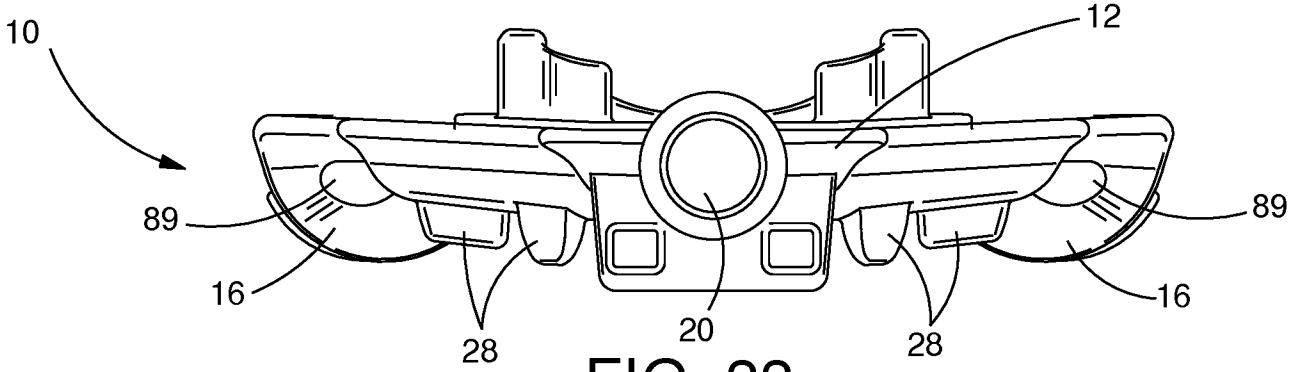
FIG. 33 is a front elevation view of the fourth embodiment of the golf tee tool.
Figure 34:
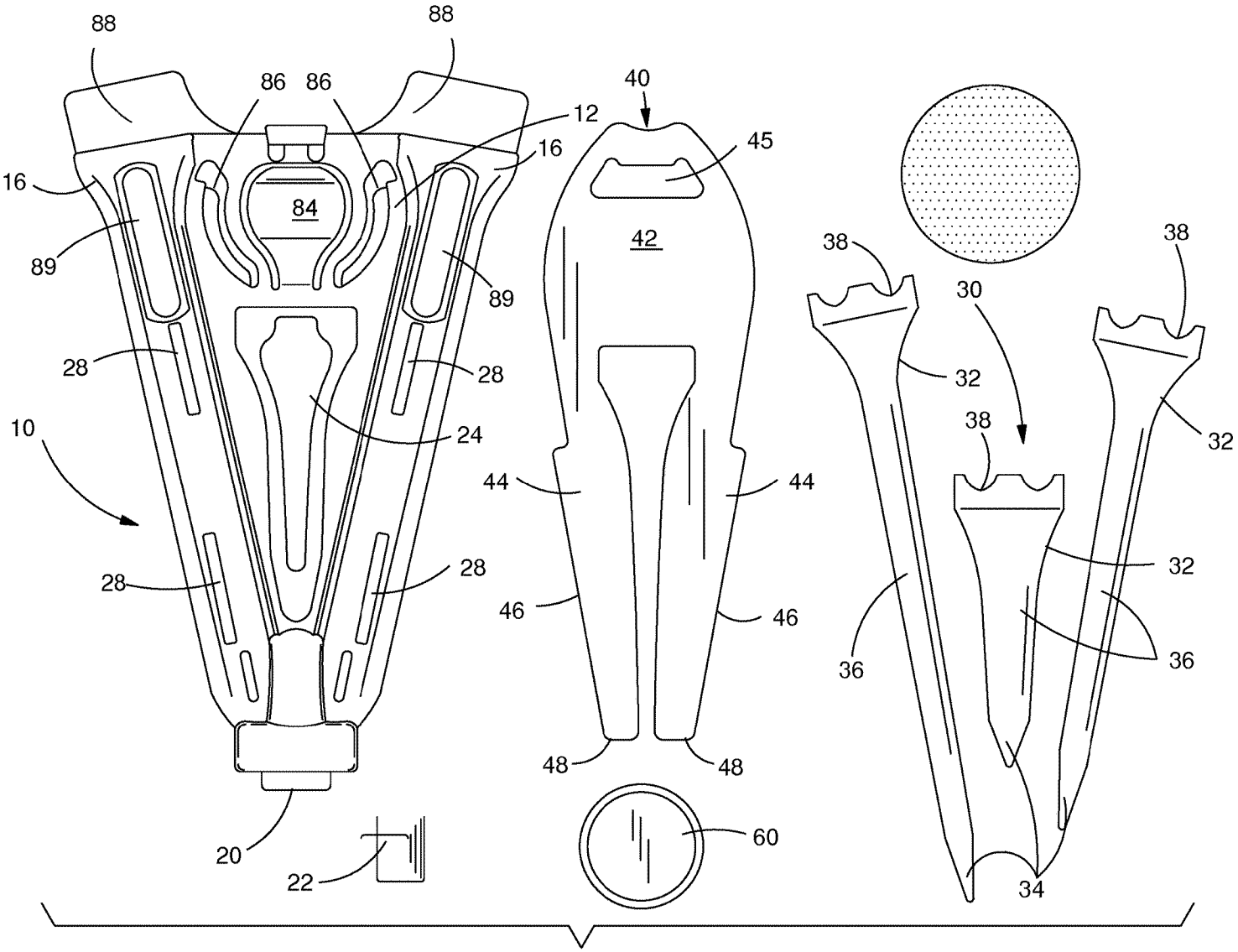
FIG. 34 is an exploded view of the fourth embodiment of the golf tee tool, with accompanying golf accessories that may be utilized with the golf tee tool.
Figure 35A:
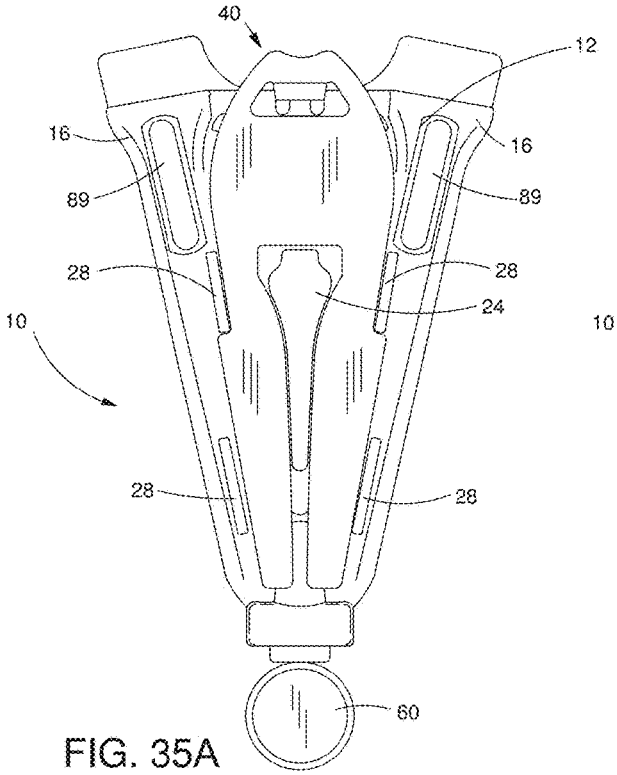
FIG. 35A is a top plan view of the fourth embodiment of the golf tee tool, shown in use with the accompanying golf accessories with the ball mark magnetically connected in a first orientation
Figure 35B:
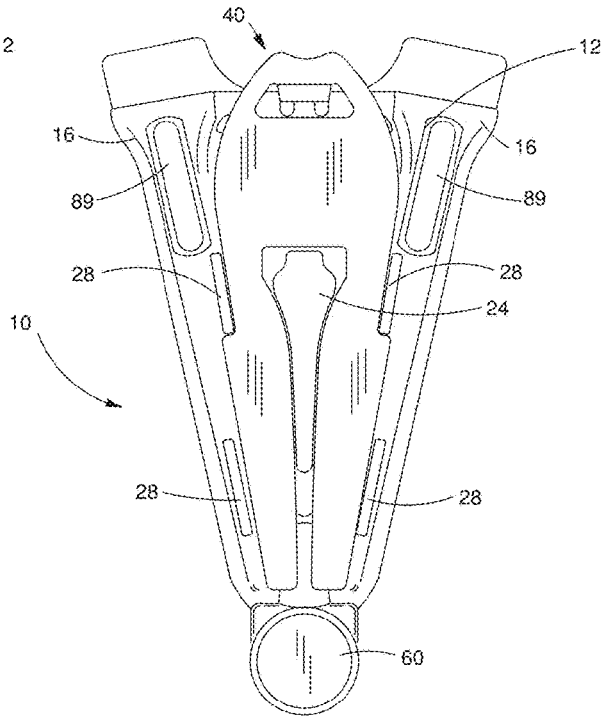
FIG. 35B is a top plan view thereof, shown in use with the ball mark magnetically connected in a second orientation.
Figure 36:
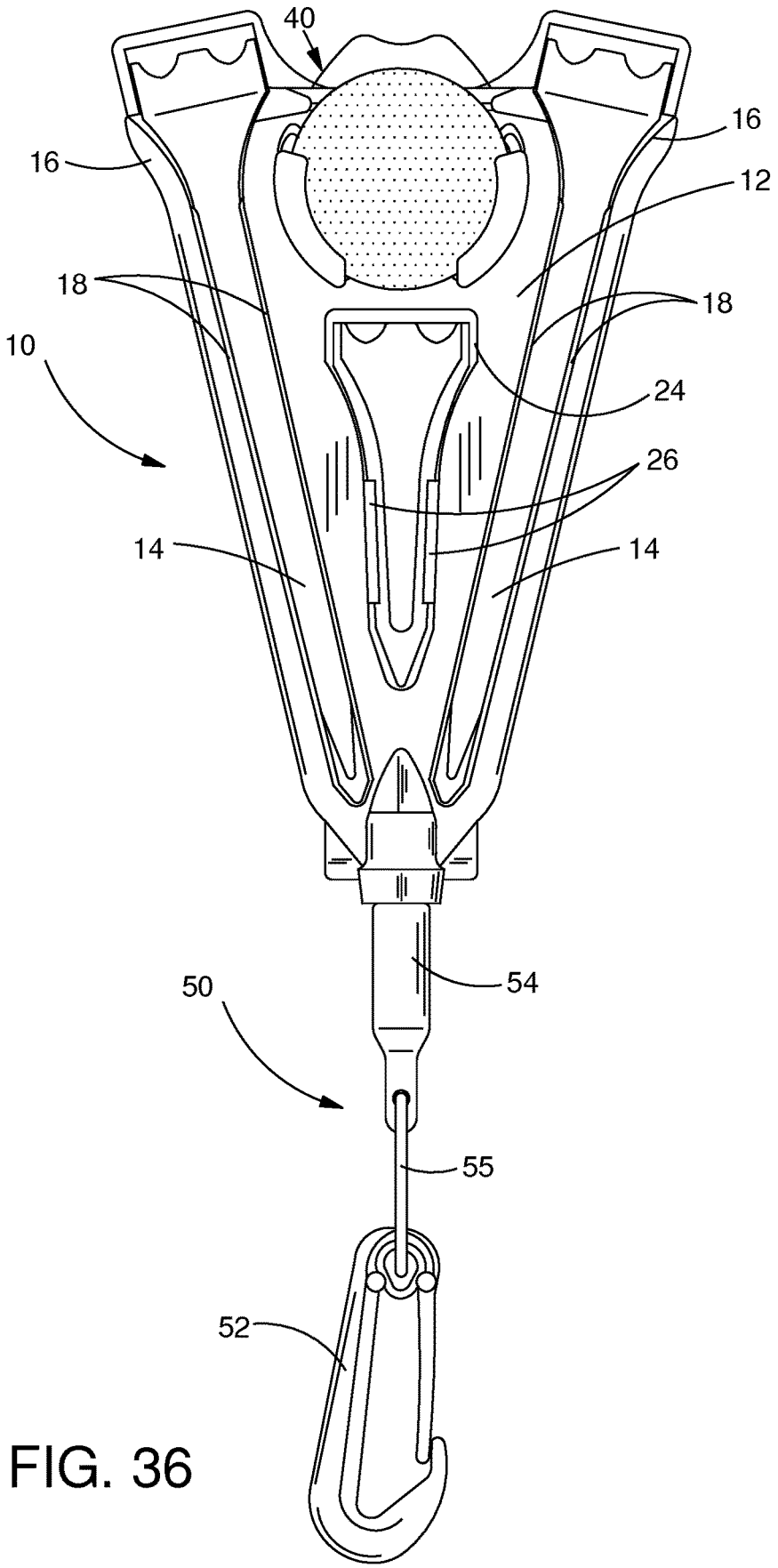
FIG. 36 is a top plan view of the fourth embodiment of the golf tee tool, shown in use with the accompanying golf accessories, shown with an optional magnetic retention clip.
Figure 37:
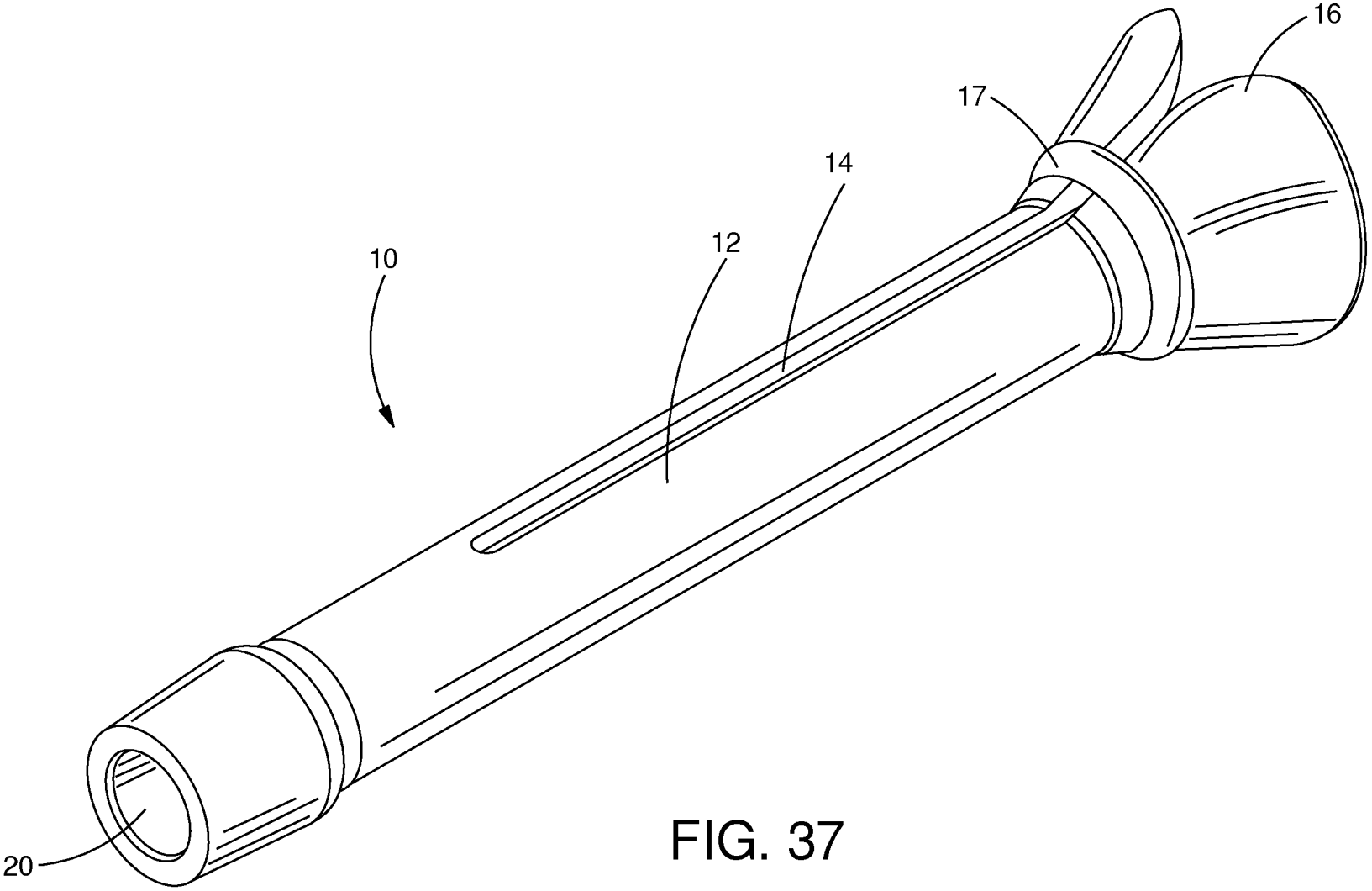
FIG. 37 is a top perspective view of a fifth embodiment of a golf tee tool.
Figure 38:
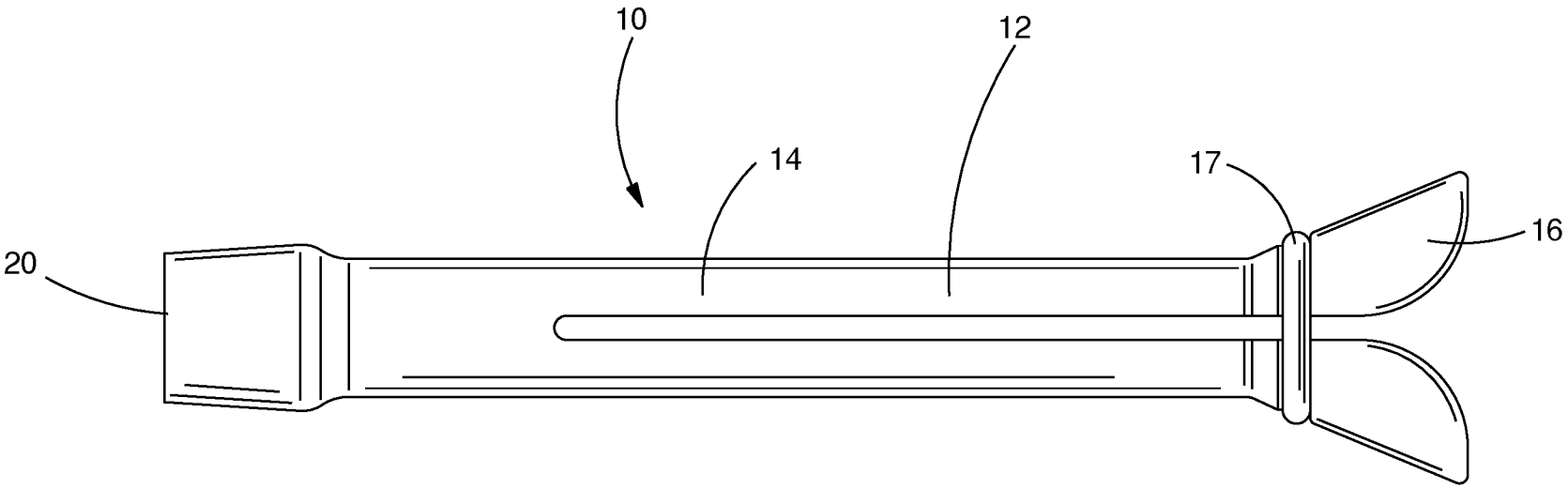
FIG. 38 is a top plan view of the fifth embodiment of the golf tee tool.
Figure 39:
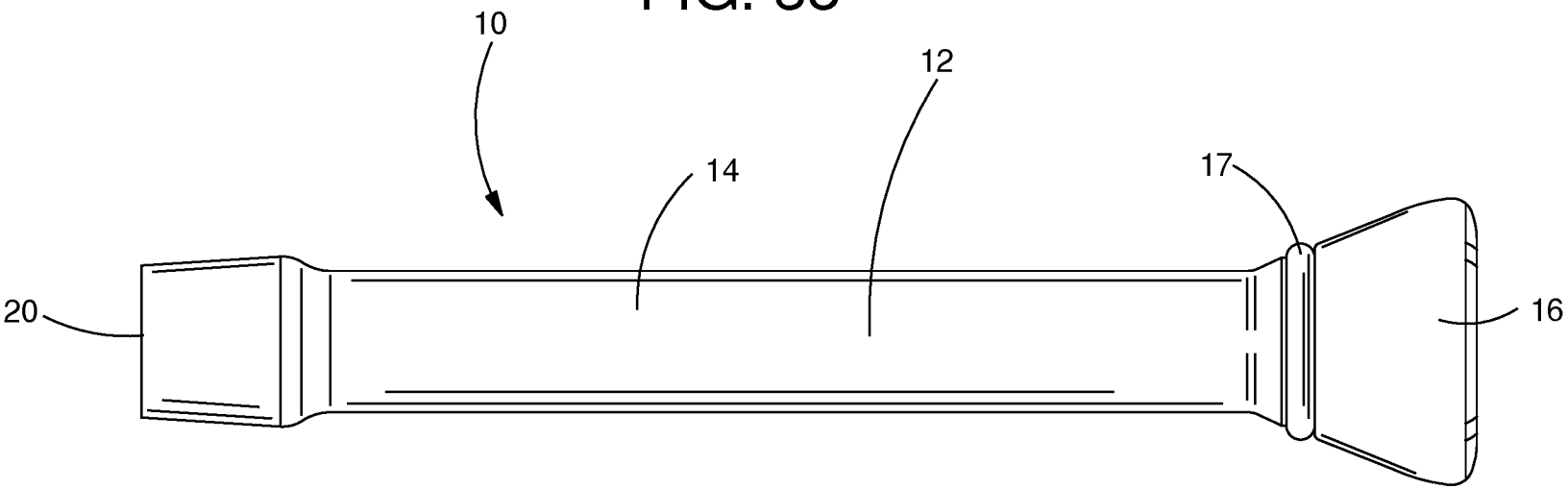
FIG. 39 is a bottom plan view of the fifth embodiment of the golf tee tool.
Figure 41:
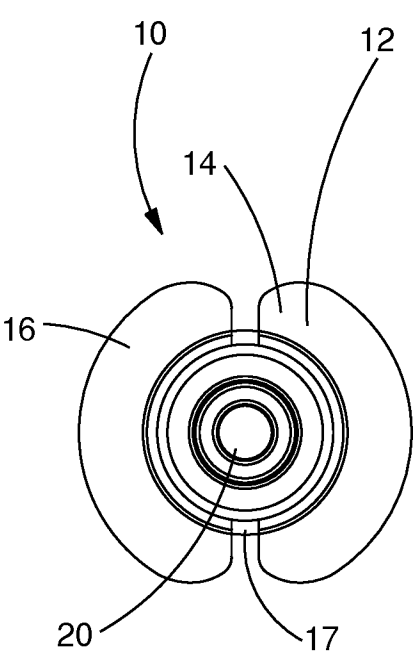
FIG. 41 is a front elevation view of the fifth embodiment of the golf tee tool.
Figure 40:
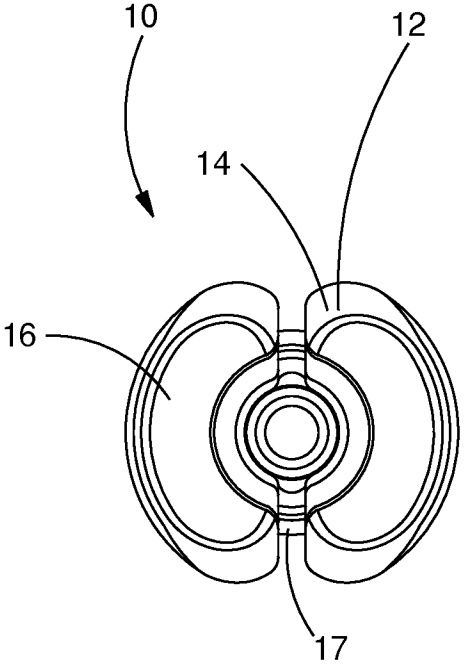
FIG. 40 is a rear elevation view of the fifth embodiment of the golf tee tool.
Figure 42:
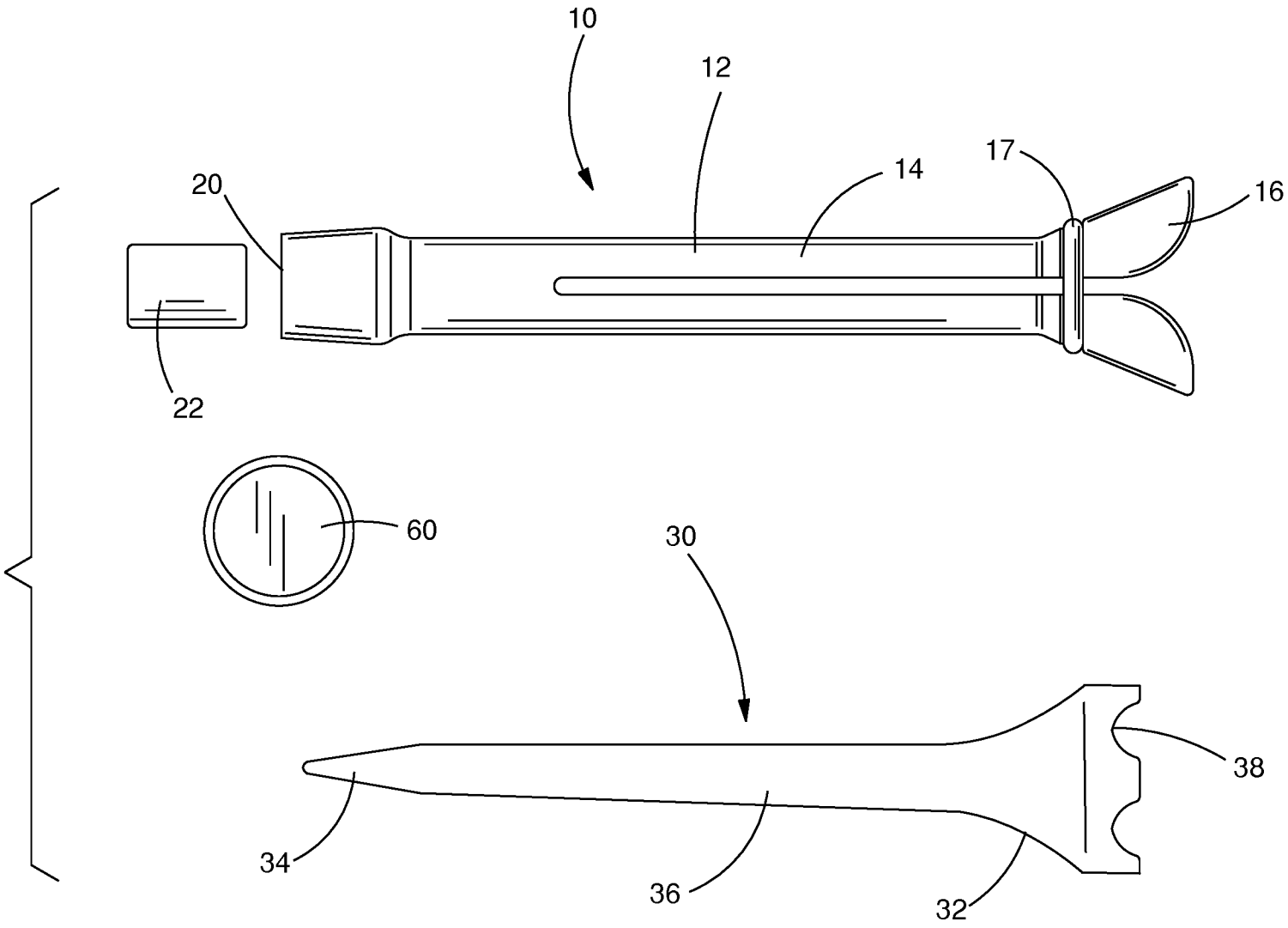
FIG. 42 is an exploded view of the fifth embodiment of the golf tee tool, with accompanying golf accessories that may be utilized with the golf tee tool.
Figure 43A:
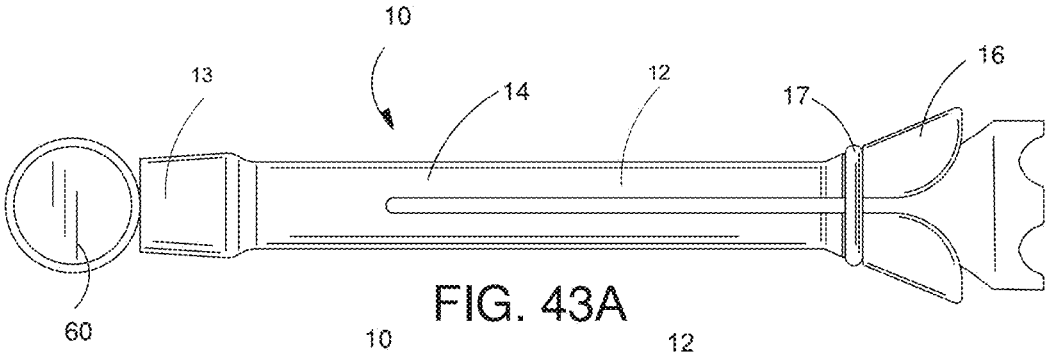
FIG. 43A is a top plan view of the fifth embodiment of the golf tee tool, shown in use with the accompanying golf accessories with the ball mark magnetically connected in a first orientation.
Figure 43B:
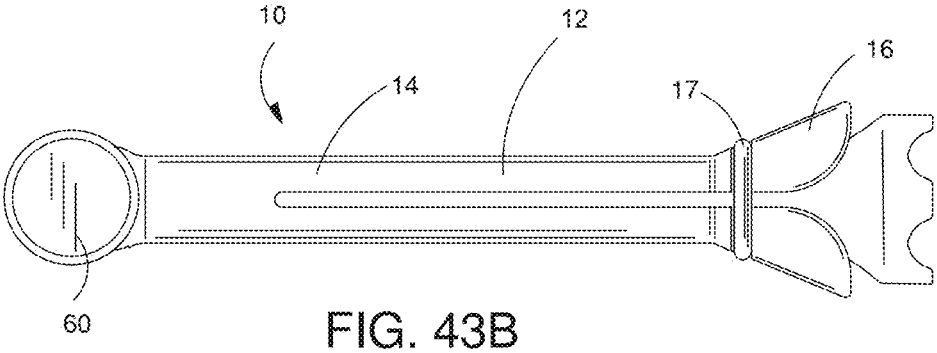
FIG. 43B is a top plan view thereof, shown in use with the ball mark magnetically connected in a second orientation, and FIG. 43C a top plan view thereof, shown in use with the ball mark magnetically connected in a third orientation.
Figure 43C:
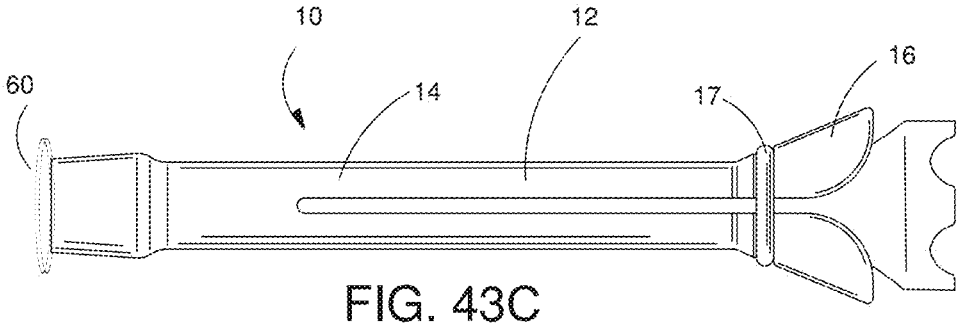

In some embodiments, such as shown in FIGS. 12 and 16, an intermediate portion of the body 12 of the golf tee tool 10 may include a receiver 70 that is dimensioned to contain a second magnet 72. The second magnet 72 may be utilized to retain the ferrous ball marker 60 with the golf teel tool 10 so that the golfer may conveniently, carry, locate, and display the ball marker 60 when needed for marking the golf ball on the putting green.

The second magnet 72 may extend between a front face and a back face of the golf tee tool 10 such that the second magnet 72 may be operable from either the front face or the back face of the golf tee tool 10. In this configuration, three points of magnetism are provided, the front surface and back surface of the body 12 of the golf tee tool 10 and the distal end of the golf tee tool 10.

In the embodiment shown in reference to FIGS. 19-27, the receiver 80 includes a slotted opening to receive the ball marker 60. Embodiments with the slotted opening do not require a ferrous ball marker 60. The slotted opening may be defined by an arcuate ridge 82 protruding from a surface of the body 12 of the golf tee tool 10. The arcuate ridge 82 has a lip 86 for retaining a face of the ball marker 60. One or more retaining tabs 84 protrude within the area surrounded by the arcuate ridge 82 and are configured to urge the ball marker 60 in abutment with the lip 86 for retention of the ball marker 60 in the receiver 80.

In the embodiment shown in FIGS. 28-36, the one or more retaining tabs 84 is configured to resiliently urge the ball marker 60 in abutment with the lip 86 of the arcuate ridge 82. A tee canopy 88 may also be provided to partially cover the end of the fluted frusto conical opening 16 to retain an end of the ball-holding cup 32 of the tee 30. The optional tee canopy 88 is advantageous for tees 30 having a narrow diameter shaft 36 that may not have an interference fit within the channel 14.

In one or more of the embodiments, the channel 14 may also include a cutout 89, preferably dimensioned to a finger's width, which allows the golfer to press on the golf tee 30 to facilitate extraction of the golf tee 30 from the channel 14.

In other embodiments, the golf tee tool 10 may also accommodate a divot tool 40 that is removably coupled with the golf tee tool 10. The golf tee tool 10 may be configured with a retaining clip or ridge 28 for removable attachment of the divot tool 40. In the case where the divot tool 40 includes a ferrous material, the divot tool may be removably coupled to the tee tool with the second magnet 72.

In embodiments where the second magnet 72 extends between the front and back surfaces of the golf tee tool 10, the tee tool may still be magnetically attached with a golf cart on a first side and the divot tool may be removably attached to a second side of the tee tool. In some embodiments a bridge of the divot tool may be coupled with the receiver protruding from the face of the divot tool.

In other embodiments, the body 12 of the golf tee tool 10 may include one or more ridges 28. The one or more ridges 28 protrude from one of the front or back surfaces of the body 12 and provide for a snap-fit engagement with the divot tool 40. In some embodiments, the one or more ridges 28 engage with an outer edge 46 of spaced apart legs 44 of the divot tool 40.

In some embodiments, the body 12 may include a recess 24 dimensioned to receive a golf tee 30 at an intermediate position of the body 12. The recess 24 may include a ridge 26 extending along a length thereof for retaining the golf tee 30 in a snap-fit relation. Typically, this configuration would be suitable for a shorter golf tee 30 for elevating the golf ball at a closer relationship with the ground surface. Advantageously, an opening 45 between the spaced apart legs 44 of the divot tool 40 may be dimensioned in the shape of the golf tee 30, permitting removal and insertion of the divot tool 40 from the golf tee tool 10 without disturbing the centrally located golf tee 30. Likewise, the golf tee 30 may be removed from the golf tee tool 10 without the need to remove the divot tool 40.

In a simplified embodiment of the golf tee tool 10 shown in reference to FIGS. 37-43, the golf tee tool 10 includes channel 14 for receiving the tip 34 and shaft 36 of the golf tee 30. The distal end of the golf tee tool 10 also includes a receiver 20 configured to retain the magnet 22.

The proximal end of the channel 14 will also have the fluted frusto conical opening 16 that is dimensioned to receive the ball-holding cup 32 of the golf tee 30. The elongated sleeve may be made of a rigid, semi-rigid, or resilient material, such as metal, plastics, rubber, composites, and the like. When the channel 14 is opened along a longitudinal length, the shaft 36 and ground-penetrating tip 34 of the golf tee 30 may be snap fitted laterally into the channel 14, and retained by a ridge 18 protruding into an opening of the channel 14. The channel 14 may also be dimensioned to encircle the shaft 36 of the golf tee 30. In the embodiment shown, a slit 19 may be defined along a length of the channel 14. A ring 17 may be provided at a base of the fluted frusto conical opening 16 to provide a cinching of the channel 14 about the shaft 36 of the golf tee 30.

The golf tee tool 10 of the present invention is not limited to use for carrying golf tees 30 in the golfer's pocket. Advantageously, one of the first magnet 22 at the distal end of the golf tee tool 10, or the second magnet 72 may be utilized to magnetically attach the golf tee tool 10 to a ferrous metallic surface of a golf cart. The other magnet may be utilized to retain the ferrous ball marker 60.

In yet other embodiments, a retaining clip 50 may be provided for removable securement of the golf tee tool 10 with a ring of the golf bag, a belt loop, or other suitable location. The retaining clip 50 includes a detachable hook 52 at a distal end thereof and a magnet (not seen) carried at a proximal end 54 of the retaining clip 50. A ring 55 may join the detachable hook 52 with the proximal end 54 of the retaining clip 50. The magnet carried at the proximal end 54 of the retaining clip 50 may be coupled with one or the first magnet 22 or the second magnet 72 of the golf tee tool.

It should be understood, of course, that the foregoing relates to exemplary embodiments of the invention and that modifications may be made without departing from the spirit and scope of the invention as set forth in the following claims.

What is claimed is:

1. A golf tee tool, comprising:

a body having a proximal end and a distal end;

at least one channel defined in a longitudinal length of the body, the at least one channel dimensioned to removably receive a ground penetrating tip and a shaft of a golf tee through an opening at the proximal end of the body;

a receptacle formed with a terminus of the distal end of the body, the receptacle having a flat side face oriented along a longitudinal length of the body, a magnet disposed in the receptacle at the distal end of the body, the magnet adapted to magnetically couple with a ferrous ball marker, such that the ferrous ball marker may be manipulated by a golfer as a fidget between a first orientation with a side edge of the ferrous ball marker coupled with an end face of the magnet, a second orientation with a face of the ferrous ball marker magnetically coupled with the flat side face of the receptacle, and a third orientation with the face of the ferrous ball marker magnetically coupled with the end face of the magnet.

2. The golf tee tool of claim 1, wherein the opening is a fluted frusto conical opening dimensioned to receive a ball holding cup of the golf tee.

3. The golf tee tool of claim 1, further comprising:

the golf tee, wherein the golf tee is received in the channel with an interference fit.

4. The golf tee tool of claim 1, wherein the at least one channel includes a first channel and a second channel, the body further comprising:

a triangular plate having a front face and a back face, the triangular plate disposed between the first channel and the second channel, wherein the first channel and the second channel converge towards the distal end of the body.

5. The golf tee tool of claim 4, further comprising:

a receiver on the triangular plate, the receiver configured to releasably retain a ball marker.

6. The golf tee tool of claim 5, the receiver comprising:

a second magnet carried in at least one of the front face and the back face of the triangular plate, the second magnet configured to magnetically retain the face of the ferrous ball marker in abutment with the at least one of the front face and the back face of the triangular plate.

7. The golf tee tool of claim 5, the receiver comprising:

an arcuate ridge protruding from at least one of the front face and the back face of the triangular plate, the arcuate ridge defining a slot dimensioned to retain the ball marker.

8. The golf tee tool of claim 7, further comprising:

a lip extending from the arcuate ridge, the lip configured to abut with the face of the ferrous ball marker when the ferrous ball marker is received in the slot.

9. The golf tee tool of claim 8, further comprising:

a tab protruding into the slot, the tab configured to urge the front face of the ball marker in abutment with the lip, when the ball marker is received in the slot.

10. The golf tee tool of claim 9, wherein the tab is resiliently disposed on the triangular plate.

11. The golf tee tool of claim 4, further comprising:

one or more ridges protruding from one of the front face and the back face of the body, the one or more ridges configured for removably receiving a divot tool in a snap-fit engagement with the body.

12. The golf tee tool of claim 11, further comprising:

the divot tool, wherein the one or more ridges engage with an outer edge of spaced apart legs of the divot tool.

13. The golf tee tool of claim 4, further comprising:

a recess defined by the triangular plate, the recess dimensioned to receive a short golf tee at an intermediate position of the body.

14. The golf tee tool of claim 13, further comprising:

a ridge extending along a length of the recess for retaining the short golf tee in a snap-fit relation.

15. The golf tee tool of claim 1, further comprising:

a retaining clip having a proximal end and a distal end;

a retaining hook at the distal end; and a retaining clip magnet at the proximal end of the retaining clip configured to magnetically couple with the magnet at the distal end of the body.

16. The golf tee tool of claim 2, further comprising:

a ring disposed about a base of the fluted frusto conical opening to provide a cinching of the channel about the shaft of the golf tee.

17. The golf tee tool of claim 1, further comprising:

a cylindrical receptacle defined at the distal end of the golf tee tool; and the magnet is received within the cylindrical receptacle.

18. The golf tee tool of claim 1, wherein the magnet is oriented to retrieve and attract the ferrous ball marker along a longitudinal length of the golf tee tool.

* * * * *